US006537150B1

(12) United States Patent
Luciano et al.

(10) Patent No.: US 6,537,150 B1
(45) Date of Patent: Mar. 25, 2003

(54) GAMING DEVICES HAVING REVERSE-MAPPED GAME SET

(75) Inventors: Robert A. Luciano, Reno, NV (US); William K. Bertram, Reno, NV (US)

(73) Assignee: Sierra Design Group, Reno, NV (US)

( * ) Notice: Subject to any disclaimer, the term of this patent is extended or adjusted under 35 U.S.C. 154(b) by 0 days.

(21) Appl. No.: 09/450,821

(22) Filed: Nov. 29, 1999

Related U.S. Application Data

(60) Provisional application No. 60/126,777, filed on Mar. 29, 1999, provisional application No. 60/127,663, filed on Apr. 2, 1999, provisional application No. 60/140,629, filed on Jun. 23, 1999, provisional application No. 60/158,589, filed on Oct. 7, 1999, and provisional application No. 60/159,766, filed on Oct. 15, 1999.

(51) Int. Cl.[7] ..... A63F 9/24

(52) U.S. Cl. ..... 463/16; 463/25; 463/42; 463/20; 273/138.2; 273/269

(58) Field of Search ..... 463/9–11, 13, 463/16, 17, 20, 26, 27, 22, 40–42; 273/138.1, 138.2, 143 R, 139, 237, 138 A, 236, 269; 283/903; 434/128; 379/93.13

(56) References Cited

U.S. PATENT DOCUMENTS

| | | | |
|---|---|---|---|
| 3,124,674 | A | 3/1964 | Edwards et al. |
| 3,252,149 | A | 5/1966 | Weida et al. |

(List continued on next page.)

FOREIGN PATENT DOCUMENTS

| | | | |
|---|---|---|---|
| AU | B-74491/87 | | 7/1988 |
| DE | OS 26 56 024 | | 12/1976 |
| DE | OS3736770 | A1 | 10/1987 |
| EP | 0 448 386 | A | 9/1991 |
| GB | 1 237 010 | | 6/1971 |
| GB | 2 048 539 | A | 3/1979 |
| GB | 2 059 270 | A | 9/1979 |
| GB | 2 128 486 | A | 10/1982 |
| GB | 0 148 135 | A | 5/1985 |
| GB | 2 147 773 | A | 5/1985 |
| GB | 2 197 971 | A | 6/1988 |
| GB | 2 105 996 | A | 4/1989 |
| GB | 2 256 594 | A | 12/1992 |
| JP | 0040156876 | AA | 10/1990 |

(List continued on next page.)

*Primary Examiner*—Mark Sager
*Assistant Examiner*—Steven Ashburn
(74) *Attorney, Agent, or Firm*—Jonathan T. Velasco; Russ F. Marsden

(57) ABSTRACT

A gaming apparatus and method first determines an outcome, and then maps that outcome to a symbol which is displayed to a player. In general, for each possible outcome, there may be a plurality of possible symbols, and the system selects a symbol by a random selection technique. The method can be practiced both for lottery-type games and non-lottery games. In the case of lotteries, the system determines the outcome by selecting a game set element from a finite pool, each game set element being associated with a particular value. The system then maps the game set element to an appropriate symbol to be displayed to the player. In another embodiment, the system can be programmed to allow the results of the game to be affected by the skill of the player. If the player plays optimally, the system can award the maximum possible value. If the player plays in a sub-optimal manner, the system can award an amount which is less than or equal to the maximum. Unused awards can be added to an award bank, which can be used to fund enhanced awards to be paid to the same or another player. The award determined by the system may also be computed by selecting multiple awards, either from the same game set or from different game sets, and adding these awards, before reverse-mapping the result to an appropriate symbol display. The invention provides more varied and entertaining games than are achievable with comparable systems of the prior art.

91 Claims, 8 Drawing Sheets

U.S. PATENT DOCUMENTS

| | | | | | |
|---|---|---|---|---|---|
| 3,327,292 | A | | 6/1967 | Eriksson et al. | |
| 3,505,646 | A | | 4/1970 | Affel, Jr. et al. | |
| 3,593,303 | A | | 7/1971 | Streets | |
| 3,810,627 | A | | 5/1974 | Levy | |
| 4,157,829 | A | | 6/1979 | Gldman et al. | |
| 4,213,524 | A | | 7/1980 | Miyashita et al. | |
| 4,494,197 | A | | 1/1985 | Troy et al. | |
| 4,652,998 | A | | 3/1987 | Koza et al. | |
| 4,689,742 | A | | 8/1987 | Troy et al. | |
| 4,817,951 | A | | 4/1989 | Crouch et al. | |
| 4,856,787 | A | | 8/1989 | Itkis | |
| 4,857,759 | A | | 8/1989 | Murphy et al. | |
| 4,943,090 | A | * | 7/1990 | Fienberg | 273/139 |
| 5,046,737 | A | * | 9/1991 | Fienberg | 273/139 |
| 5,083,271 | A | | 1/1992 | Thacher et al. | |
| 5,092,598 | A | * | 3/1992 | Kamille | 273/139 |
| 5,106,089 | A | * | 4/1992 | Wood | 273/139 |
| 5,118,109 | A | * | 6/1992 | Gumina | 273/139 |
| 5,216,595 | A | | 6/1993 | Protheroe | |
| 5,324,035 | A | | 6/1994 | Morris et al. | |
| 5,401,023 | A | * | 3/1995 | Wood | 273/85 |
| 5,407,199 | A | * | 4/1995 | Gumina | 273/139 |
| 5,456,465 | A | | 10/1995 | Durham | |
| RE35,864 | E | * | 7/1998 | Weingardt | 463/28 |
| 5,788,237 | A | * | 8/1998 | Fults et al. | 273/269 |
| 5,967,894 | A | * | 10/1999 | Kinoshita et al. | 463/12 |
| 5,996,997 | A | * | 12/1999 | Kamille | 273/139 |
| 6,024,640 | A | * | 2/2000 | Walker et al. | 463/17 |
| 6,113,492 | A | * | 8/2000 | Walker et al. | 463/16 |
| 6,126,541 | A | * | 10/2000 | Fuchs | 273/143 R |
| 6,241,608 | B1 | * | 5/2001 | Torango | 463/27 |
| 6,250,685 | B1 | * | 6/2001 | Walker et al. | 283/49 |
| 6,422,940 | B1 | * | 6/2002 | Walker et al. | 463/13 |

FOREIGN PATENT DOCUMENTS

| | | |
|---|---|---|
| WO | WO89/06998 | 8/1989 |
| WO | WO90/14139 | 11/1990 |
| WO | WO91/06354 | 5/1991 |
| WO | PCT/F190/00254 | 5/1991 |
| WO | WO92/10806 | 6/1992 |
| WO | WO93/25290 | 12/1993 |

* cited by examiner

GAMING DEVICES HAVING REVERSE-MAPPED GAME SET

CROSS REFERENCE TO RELATED APPLICATIONS

This application claims priority of and incorporates by reference the following U.S provisional patent applications: No. 60/126,777, filed on Mar. 29, 1999, No. 60/127,663, filed on Apr. 2, 1999, No. 60/140,629, filed on Jun. 23, 1999, No. 60/158,589, filed on Oct. 7, 1999, and No. 60/159,766, filed on Oct. 15, 1999.

BACKGROUND OF THE INVENTION

This invention relates to the field of gaming, and provides a system and method which enhances the entertainment value of a game. The invention is especially adapted for use with, but not necessarily limited to, lottery-based games.

Conventional gaming machines employ direct mapping between the symbols displayed to the player, and the award paid out. As used in this specification, the term "direct mapping" means that the system first determines the displayed symbol, and then maps that symbol to an award level. A simple example of a conventional direct-mapped gaming machine is an ordinary mechanical slot machine. The slot machine contains a plurality of wheels, each wheel bearing a set of symbols. The configuration of symbols on each wheel determines a probability of obtaining any particular combination of symbols when playing the machine. Each combination is mapped, or associated with, an award. The machine includes, implicitly or explicitly, a "pay table" which shows the award associated with each combination. When a player achieves a given combination, the machine maps that combination to the appropriate award (which may be zero), and pays the player accordingly.

The above-described mechanical slot machine can be replaced by an electronic version, but the principle of operation is still the same. Through appropriate random number generators, the machine derives a combination of symbols, and this combination is mapped directly to an award which is then paid to the player.

The direct-mapped systems of the prior art have several disadvantages. First, the games have limited variety. A conventional mechanical or electronic slot machine can function in essentially one way only, and the games playable on such machines tend to become boring to the player. Secondly, some direct-mapped systems of the prior art allow little or no opportunity for a player to exercise a degree of skill. In the example of the slot machine, the player has no role in the determination of the eventual award, other than by inserting money and pushing a button to operate the machine.

A third disadvantage of the direct-mapped systems of the prior art relates to legal requirements. Some jurisdictions permit only gaming devices which function as lotteries, i.e. games in which there is a finite pool of prizes from which to draw. A pure slot machine, of the type which spins a set of wheels (either mechanical or virtual) to obtain a combination of symbols, is not a true lottery, as described above, because the number of potential prizes of a particular category is, at least in theory, unlimited. While a direct-mapped system can be used with a true lottery, such systems are difficult to implement, at least in part because the probability of each possible outcome changes as the pool of awards is depleted, and this changing probability must be appropriately modeled by the system.

Another disadvantage of systems of the prior art results from legal restrictions on "bonus" awards. Some jurisdictions effectively limit the use of bonus or secondary event awards, by requiring that such awards not be counted in determining the net payout of a gaming device. These rules tend to limit the flexibility available to the designer of a game. The reverse-mapped system of the present invention provides more flexibility, and can be more easily tailored to comply with local regulations while still providing a varied and entertaining game, through the use of bonus and secondary event simulations that are reverse-mapped from pre-determined award outcomes.

It has been known to provide a lottery-type game which includes a pool of a fixed number of plays, all having pre-selected winning and losing outcomes. U.S. Pat. No. 5,324,035, the disclosure of which is incorporated by reference herein, describes such a system. Due to the fact that all of the outcomes and displays are pre-selected, the entertainment value of the game is limited. Such games also do not lend themselves to the application of skill in determining the outcome.

U.S. Pat. No. 4,494,197, the disclosure of which is incorporated by reference herein, discloses an electronic lottery system. In one embodiment, the latter system simulates a bowling game, and presents a display to the player corresponding to a winning or losing play, depending on whether the system has electronically selected a win or a loss. The latter system, however, is limited in the variety of games that can be constructed. Also, the patented system does not provide a convenient means for incorporating an element of player skill into the game, or for providing one or more bonus awards to players. The present invention comprises a substantial improvement over the above-described patents.

The present invention provides a gaming system and method which solves all of the problems mentioned above. The system of the present invention provides games which are more exciting, and more varied, as perceived by the player. The present invention makes it more feasible to incorporate aspects of skill into the play. The invention also makes it possible to provide multiple award sequences. simulated secondary awards, and/or bonus awards to players. The present invention provides games which can be easily modified, by simple software changes only, to change the character of the games. Finally, the present invention is especially suitable for use with lottery-type games, and is therefore suitable for use in jurisdictions which require finite pools of awards in a gaming system.

SUMMARY OF THE INVENTION

The present invention comprises a gaming system and method in which the outcome of a play is determined first, and then the outcome is mapped to a symbol suitable for display to the player. The method is called "reverse mapping" because the outcome is determined first, and is then associated with, or mapped to, a symbol which corresponds to that outcome. In most cases, the outcome can be reverse-mapped to any one of a plurality of symbol combinations, so the mapping function is, in general, not one-to-one.

The invention can be practiced with lottery-type games, or with other games. An example of a non-lottery game, which, by definition, uses an infinite "pool" of awards, could be an electronic slot machine. In the latter case, the system determines an outcome, without depleting any pool of awards, using a predetermined probability distribution. The system then reverse-maps that outcome to a symbol combination which is displayed to the player. If each of a plurality of symbols corresponds to the same outcome, then the system must choose randomly among them, to determine which symbol is to be displayed. Because the "pool" is not depleted, the probability of obtaining a particular award does not change from play to play.

When using the present invention in a lottery-type game, having a finite pool of awards, the system chooses a game set element from the finite pool. Each game set element is coded for a particular award, and/or for a bonus award, so the choice of the game set element determines what award can be won by the player. Then, the system associates (reverse-maps) that award with a symbol to be displayed to the player, consistent with the value of the award. For each play, the game set element is withdrawn from the pool, so the probability of selecting a particular game set element in the pool varies from play to play. By contrast, in a game which uses an infinite game set, a game set element is selected randomly for each play, and the probability of selecting a particular game set element does not vary from play to play.

The reverse-mapped game can be combined with an element of skill to provide an even more varied and entertaining game. For example, in a lottery-type game based on video poker, the system selects a game set element, from a pool, the game set element representing a "best" hand achievable by the player on that particular play. The system deals cards to the player, and gives the player the chance to hold or replace each card, according to the rules of poker. If the player chooses an optimal or other pre-determined strategy, the system fulfills the player's choice with cards which correspond to the maximum award associated with the game set element. If the player chooses a sub-optimal strategy, then the system may fulfill the player's choice with cards corresponding to an amount which is less than or equal to the maximum award amount. The difference between the maximum possible award and the amount actually awarded to the player may be placed in an electronic "bank" which can be added to the awards available on subsequent plays. A plurality of player terminals can be linked together, and the un-awarded amounts from one terminal can be added to a common "bank" shared by all of the terminals. In this way, the entertainment value of the game is still further enhanced.

Games made according to the present invention can be varied still further by drawing two or more game set elements from the same game set, or from different game sets, especially in response to a multiple wager by the player, adding the values of these elements, and reverse-mapping the result to an appropriate symbol display. The award displayed to the player may be the same as the sum of the values of the selected game set elements, or it may be less, in which case the system deposits the unawarded portion into one or more funds used to support bonus plays, progressive awards, or "mystery" awards. In this way, the games created by the present invention include a substantial degree of unpredictability, from the point of view of the player, even though the system pays out, in the aggregate, the same percentage to players. In one simple example, a two-credit game, played according to the present invention, has a substantially different appearance from a one-credit game, even where the game set elements are otherwise the same. The above variations can be applied both to the case of lottery games and non-lottery games, and can be used with games of pure chance and games involving an element of skill.

In another embodiment of the present invention, the system selects a game set element from a finite pool, each game set element being coded either with an amount to be awarded or a symbol indicating a bonus award. If the game set element contains an amount, the player may win that amount, or some lesser amount (in which case the balance is added to a separate bonus fund), the outcome being determined randomly or according to a pre-determined probability distribution. If the selected game set element is coded or is otherwise determined to be applied as a bonus award, the player may receive all or part of the stored bonus fund, either in a single award or in a multi-step display/award sequence. Thus, in this embodiment, the player may receive an amount which is equal to or less than an amount shown on the game set element. Bonus awards can also be made where the game set element is not specially coded for a bonus, and can be awarded in multiple steps.

The invention has the advantage that it greatly facilitates the construction of varied and entertaining games. Moreover, a given game can be changed without making any hardware changes, and by making only minor software adjustments, i.e. by changing a game set "template" used to create a pool of game set elements to be stored in a computer memory. The invention requires no probabilistic analysis of the display symbols, because these symbols are selected only after the outcome is determined. Moreover, because a given outcome can be mapped, in general, to a plurality of different symbols, the game as perceived. by the player is much more varied than comparable games of the prior art.

In another embodiment, the invention includes a video lottery poker game which may comprise one or more draws from finite pools of game set elements. In one version of this embodiment, an initial hand is presented to the player, the hand being determined by a game set element drawn from a finite pool. Unless the initial hand is a winner, in which case an award is made and the game ends, the player is given the opportunity to decide which cards to hold or replace, in an attempt to create a winning hand. Based in part on the cards initially dealt, and in part on the strategy selected by the player, the system selects another pool of game set elements from which to draw. If this second draw produces a winning hand, the player receives an award. In another version of the above game, the initial hand is determined by random calculation, and not by drawing an element from a finite pool. The game is otherwise the same as in the previous version.

The present invention therefore has the primary object of providing a method and system for playing a game, wherein the outcome of each play of the game is reverse-mapped to a symbol to be displayed to a player.

The invention has the further object of enhancing the variety and entertainment value of existing games.

The invention has the further object of providing a variety of possible games using the same gaming equipment.

The invention has the further object of providing a gaming system and method which. can be used either with lottery-type games or with games which have no fixed pool of awards.

The invention has the further object of providing a reverse-mapped gaming system and method, in which the skill of the player can affect the amount won in the game.

The invention has the further object of providing a reverse-mapped gaming system and method, suitable for use with a plurality of gaming terminals linked together in a network.

The invention has the further object of providing a game which can be easily modified.

The invention has the further object of providing a gaming system and method wherein a single game set can be used to operate a plurality of different games having differing structures, as perceived by a player.

The invention has the further object of providing games which include bonus awards, or multiple award sequences, and which enhance the unpredictability of the games from the point of view of the player.

The invention has the further object of providing games involving skill, such as video poker.

The invention has the further object of providing a game in which a player has more than one chance to win, on a given play.

The invention has the further object of providing a game in which the skill of a player may affect the amount awarded to the player, and the amount added to a bonus fund for later distribution.

The reader skilled in the art will recognize other objects and advantages of the present invention, from a reading of the following brief description of the drawings, the detailed description of the invention, and the appended claims.

DETAILED DESCRIPTION OF THE INVENTION

Figure 1:
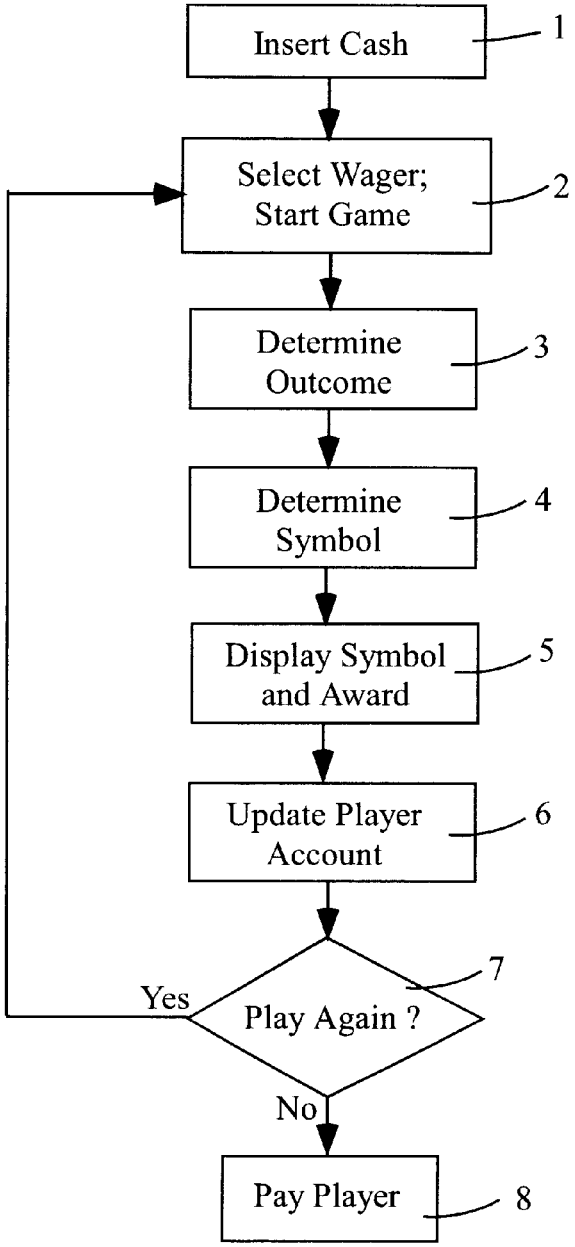
FIG. 1 provides a flow chart showing the programming of a reverse-mapped game according to the present invention.

One basic form of the method of the present invention comprises the steps of randomly selecting an outcome, and then associating that outcome with a symbol to be displayed to the player. The process of associating the outcome with a symbol is called "reverse mapping", because, in the present invention, a potential or final award outcome is determined first, and the system then finds-a symbol display, or series of displays, which can logically be associated ("mapped") with the outcome.

In the reverse-mapped games of the present invention, the mapping of a final outcome to the displayed symbol may not be one-to-one. Instead, there may be, in general, many different symbol combinations that correspond to a selected final outcome. An important step in the method of the present invention is the selection of one of these symbol combinations which corresponds to the selected outcome. As will be shown below, the fact that the mapping is not one-to-one makes the game more varied and more entertaining.

The above-described process is especially suited for use with lotteries, which include finite pools of awards, but can also be used with random games which are not lotteries, i.e. where there are no finite pools. The following description, illustrated by Tables 1 and 2, provides a simple example of a game which comprises an electronic slot machine.

TABLE 1

| Symbol | Award |
|---|---|
| 777 | 25 |
| BBB | 10 |
| PPP | 10 |
| 000 | 10 |
| CCC | 5 |
| DDD | 5 |
| TTT | 5 |
| MMM | 3 |
| XXX | 3 |
| Mixed | 0 |

Table 1 comprises a "pay able", or payoff matrix, for this first example award associated with each symbol. The term "mixed" refers to all combinations not explicitly shown. It is assumed that on each play, the player wagers one unit, and the award is measured in terms of the same units. Of course, a game may be structured such that more than one unit can be wagered at one time, in which case the awards can be multiplied by the number of units wagered.

In the above example, there are five possible awards, namely 25, 10, 5, 3, and 0. In the operation of the present invention, a computer is programmed to select first one of these awards according to a predetermined probability distribution. For example, the probability of obtaining each possible award could be determined according to the distribution shown in Table 2:

TABLE 2

| Award | Probability |
|---|---|
| 25 | .01 |
| 10 | .03 |
| 5 | .05 |
| 3 | .06 |
| 0 | .85 |

The computer selects one of the available awards according to the indicated probability distribution. In the above example, the mean award would be 0.98, with a standard deviation of about 3.17. Thus, when a player wagers one unit, the expected payback is 0.98 units.

After selecting the award, the computer then determines a symbol to be displayed to the player. In this example, if the award is 25, there is only one allowable symbol, namely "777", and the system displays this symbol to the player. If the award is 10, there are three possible symbols, namely "BBB", "PPP", and "000". The program then selects one of these symbols, such as by randomly selecting one of them with equal probability. If the award is 5, the program would select one of the symbols "CCC", "DDD", or "TTT", with equal probability. If the award is 3, the program can select one of the symbols "MMM" and "XXX", again with equal probability. If the award is zero, the program can select any of the other symbols available (not shown in the table).

The procedure for using a probability distribution to select an outcome, by computer, is well known in the art of Monte Carlo methods. For example, the selection from Table 2 could be obtained by generating a random number between 1 and 100, and selecting 25 if the random number is 1, selecting 10 if the random number is between 2–4, selecting 5 if the random number is between 5–9, selecting 3 if the random number is between 10–15, and selecting zero if the random number is between 16–100. If the random number generator is properly configured so that it produces a true random number within the stated range, the above procedure will select the various awards with the desired probabilities. Other techniques could be used instead of the method described above.

The above-described game is a simple example of reverse mapping. That is, the system first determines an outcome, i.e. an award to be paid, and then the system reverse-maps that outcome to a symbol which is to be displayed.

The basic game described above can be summarized, and generalized, according to the flow chart of FIG. 1, which comprises the essential programming of a computer which implements the invention. In block 1, the player inserts cash (or a cash equivalent, such as a voucher for credits) into a terminal or other gaming machine. In block 2, the player selects the amount to be wagered, and presses a button which starts the game. In block 3, the system determines the outcome, i.e. the award, of the play, using the technique described above, or its equivalent. In block 4, the system determines a symbol to be displayed to the player, the symbol being consistent with the outcome previously determined. In block 5, the system displays the symbol to the player, and also displays the associated award (which may be zero).

In block 6, the system increments a credit account according to the amount won by the player. If the award is zero, the account is incremented by zero. In test 7, the player is given the option of playing again or terminating the game. If the player elects to terminate, the program proceeds to block 8, which pays the player the net winnings, if any, either in the form of cash or an appropriate cash substitute. If the player chooses to continue, the program returns to block 2.

The above example relates to a slot machine, in which the available supply of awards is theoretically unlimited. The same principle can be applied to a lottery game, in which there is a finite pool of awards. The following description, made with respect to Tables 1 and 3, provides a simple example of such a lottery game, again in the context of an electronic slot machine.

TABLE 3

| Award | Number of Elements in Game Set | Award Contribution |
|---|---|---|
| 25 | 2 | 50 |
| 10 | 5 | 50 |
| 5 | 10 | 50 |
| 3 | 25 | 75 |
| 0 | 186 | 0 |
| Totals | 228 | 225 |

Table 3 represents the finite pool of elements in the game set. In practice, a game set element physically comprises an element of data, stored in a computer memory, which element identifies the award associated with that element. For example, the computer can store a plurality of game set elemennts as an array, each element of the array identifying a monetary value. The array defines the desired probability distribution according to the number of elements having a particular value. For example, if in a particular game, it is desired to award one thousand dollars, with an initial probability of 0.0001, and if the array contains 10,000 elements, then there should be one element in the array having the value of one thousand dollars.

In the simplified example of Table 3, there are two elements associated with a award of 25, five elements associated with a award of 10, and so on. The product of the award and the number of corresponding elements of the game set is shown in the third column, and represents the total amount that can be won from the awards of a given level. The sum of the values in the third column therefore represents the total of awards available to be paid to the player. The sum of the values in the second column is the number of elements in the pool. In the example of Table 3, the system will eventually pay out 98.68% (225/228) of the total amount wagered.

In operation, the computer randomly selects a game set element from the finite pool. As explained above, each such element is coded so that it is associated with a particular award. The system must then translate, or reverse-map, that award into an appropriate symbol display. The latter step is done by using Table 1, as before. For example, if the system has chosen one of the five elements having a award of 10, the system must then select, from FIG. 1, one of the symbol displays (either "BBB", "PPP", or "000") corresponding to a award of 10, to be shown to the player. The chosen game set element is then removed from the pool.

In the latter example, the probability distribution governing the selection of game set elements is inherent in the finite pool, and need not be separately calculated. The pool can be visualized as a homogeneous mix of game set elements. The probability of selecting a given element is determined by the number of elements remaining in the pool. Clearly, the game set elements associated with large awards (such as the award of 25, in Table 3) are present in very small numbers, so the probability of selecting those elements is relatively small. Note also that the probability of selecting any element changes after each play, because the size of the pool is reduced slightly after each play. The initial probability of obtaining each award can clearly be established by determining the/-number of elements in the game set associated with each possible award.

The probability of choosing each symbol combination corresponding to the selected award can be varied. In the above example, it was assumed to be a uniform distribution. That is, in the example of Table 1, where "BBB", "PPP", and "000" all correspond to the value of 10, if the system seeks a symbol combination corresponding to a value of 10, it can be programmed to select one of these three combinations with equal probability. But this rule could be modified, such that a non-uniform distribution is used, and doing so would add further to the variety and unpredictability of the game.

An important variation on the above example is the possibility of varying the award according to the skill exhibited by the player. The player terminal can be programmed to receive input from the player, and this input can be evaluated to determine whether the player's input represents an optimal or sub-optimal game strategy. In the above example of a slot machine, the player can be given the opportunity of stopping a set of virtual or fixed wheels, and the extent to which the player is successful in stopping the wheels to yield repeated symbols depends on the skill of the player. The award indicated in the above tables would then be the maximum allowable award for that particular play. If the player fails to perform in the most optimal manner, the system is programmed to adjust the award so that the award is less than or equal to the maximum allowable value. The amount of adjustment can be predetermined for each play, or it can be determined randomly. The unused award can then be transferred to an electronic storage facility, and can be awarded to a player later. The latter concept can be used to create special awards, which can be fixed, or which can be "progressive" jackpots wherein the available award continues to grow until won by a player. Progressive awards will be discussed in more detail later, in connection with the example of a video poker game.

Figure 2:
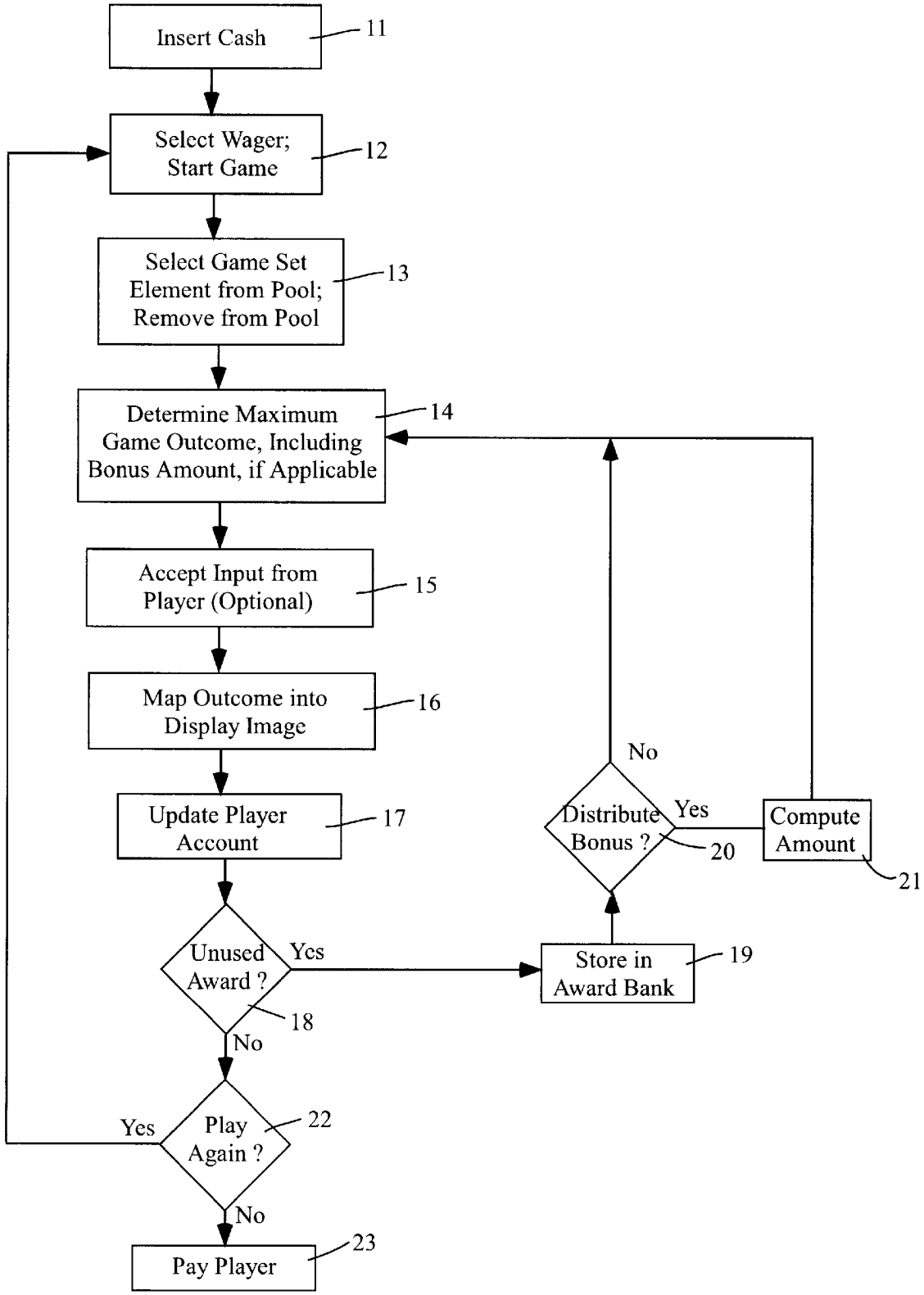
FIG. 2 provides a flow chart showing the programming of a lottery-type reverse-mapped game, according to the present invention.

The basic lottery game described above can be summarized according to the flow chart of FIG. 2, which represents the programming of a computer which implements this aspect of the invention. In block 11 of FIG. 2, the player inserts cash, or its equivalent, into the machine. In block 12, the player selects a wager, as before, and presses a button which starts the game. In block 13, the system selects (either randomly, sequentially, or by any other means of selection) a game set element from a finite pool of such elements, and electronically removes that element from the pool. In block 14, the system determines a maximum possible game outcome, which may include an addition of bonus funds obtained from a stored bank of unused awards.

Block 15 is optional, and may be included if the game is to include an element of skill. In block 15, the system accepts input from the player. In the example of a slot machine, this input may be a signal produced by the player's manual attempt to stop a virtual wheel. In the case of video poker (to be described in more detail later), the skill may be in the player's strategy of which cards to hold and which cards to replace. If the game does not include any element of skill, then block 15 would be omitted.

In block 16, the system reverse-maps the determined maximum outcome, as modified by input from the player (if such input is received), into an appropriate display image, and displays that image to the player. In block 17, the system increments the player's account with the amount won, if any.

Test 18 determines whether there is any unused award, i.e. if there is a difference between the maximum available award and the award actually received. The latter difference will be nonzero, for example, if the game involves an element of skill, and if the player has performed in a sub-optimal manner. If there is an unused portion of the award, the unused portion can be stored in an electronic award bank, in block 19. Test 20 determines whether and how a part of the award bank is to be awarded. If an award is to be made, the system computes the amount of the award bank to be awarded, and that amount will be added to the maximum outcome determined in block 14.

The determination, in test 20, of how to distribute a bonus or game play award, can be made by entirely random means, or it can be programmed to occur after a predetermined number. of plays. Many other rules can be devised to determine when the bonus will be awarded. Similarly, the amount of the bonus that is distributed at one time can be predetermined, or it can vary according to any pseudo-random scheme. In the present invention, a bonus can include a monetary award or other prize, or it could comprise one or more free chances to play again.

In test 22, the player is given the opportunity to decide whether to play again. If the player wishes to continue, the program returns to block 12. If the player wishes to stop, the program proceeds to block 23, where the player is paid whatever amount has been won.

The games made according to the present invention, in both of the examples discussed above, have several important advantages. First, the use of the reverse-mapping procedure makes it possible to construct a game which is varied and entertaining, but which still has the same overall payout as a conventional game using direct mapping. By using reverse-mapping, one can vary the displays seen by the player, even though the underlying probabilities which govern the game are the unaffected. Thus, it is possible to program the gaming machine with a wide variety of games, or with different variations of the same type of game, by making only minor software changes, and without modifying the equipment used to play the game.

Second, the use of reverse-mapping eliminates the need to reconfigure the probabilities of obtaining each possible symbol displayed to the user. In the example of the slot machine, one need not re-create the electronic "wheels" for each change in the game. Instead, one directly controls the outcome, and reverse-maps that outcome to any available symbol display which is consistent with a pay table shown to the player.

Thirdly, when used in a lottery-type game, the reverse-mapping process of the present invention makes it very easy to create a more varied and entertaining assortment of lottery games, which games are suitable in jurisdictions which require that the games be true lotteries.

Also, the present invention is especially suited for use in environments where large numbers of gaming machines are interconnected through a network. This aspect of the invention will be described next.

Figure 3:
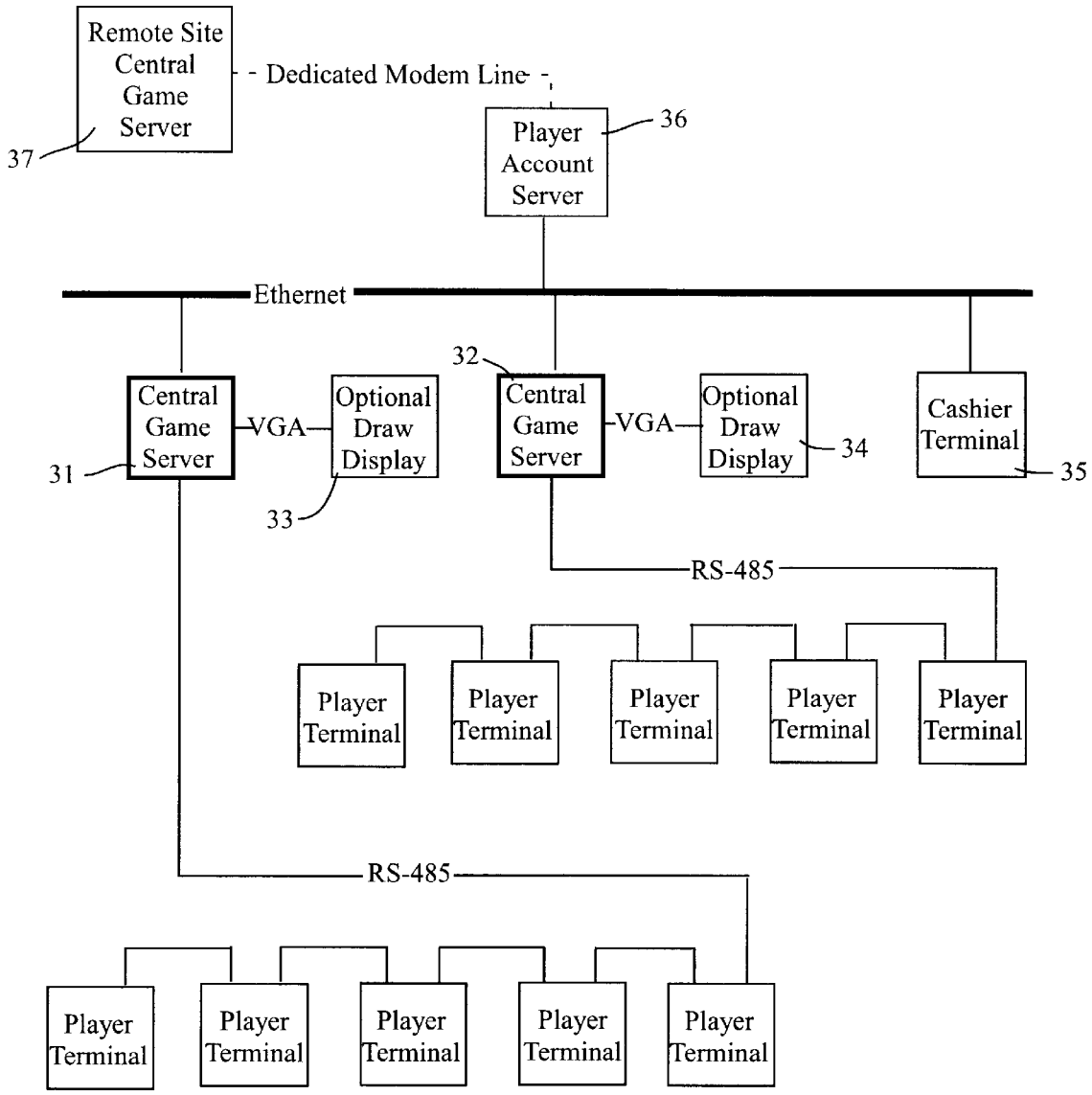
FIG. 3 provides a block diagram showing a network of gaming terminals, used in the reverse-mapped system of the present invention.

FIG. 3 provides a block diagram showing a simplified network of gaming machines. This figure shows two central game servers 31 and 32, each being connected to a plurality of player terminals. Server 31 may include an optional display 33 which facilitates the monitoring of the status of the terminals under the control of that server. Similarly, server 32 may be associated with display 34. All of the servers are shown connected in a network, which also includes cashier terminal 35 and player account server 36. The player account server performs the bookkeeping necessary to keep track of credits and debits for each player. The entire system may be linked, by a modem, to remote-site central game server 37.

Among other things, the central game servers may act as repositories of game set elements to be used by the various terminals, in lottery-type games. That is, each time a player starts a game, the player terminal obtains a game set element from the finite supply located in the central game server. Also, if the game involves an aspect of skill, and if the player's play is sub-optimal, the player terminal may be programmed to return, to the central game server, the unused portion of an award, so that the unused portion may be added to the award bank discussed above. An award bank can also be maintained even if no element of skill is involved. This award bank could be made available only to the terminal from which it came, or, more preferably, it can be made available to other terminals controlled by the same server. The latter alternative provides a more varied and interesting game, because one player can benefit, indirectly, from mistakes made by another players at different terminals. Thus, the network further enhances the variety of the games, because the players operating the various networked terminals are, in effect, competing with each other.

Figure 4:
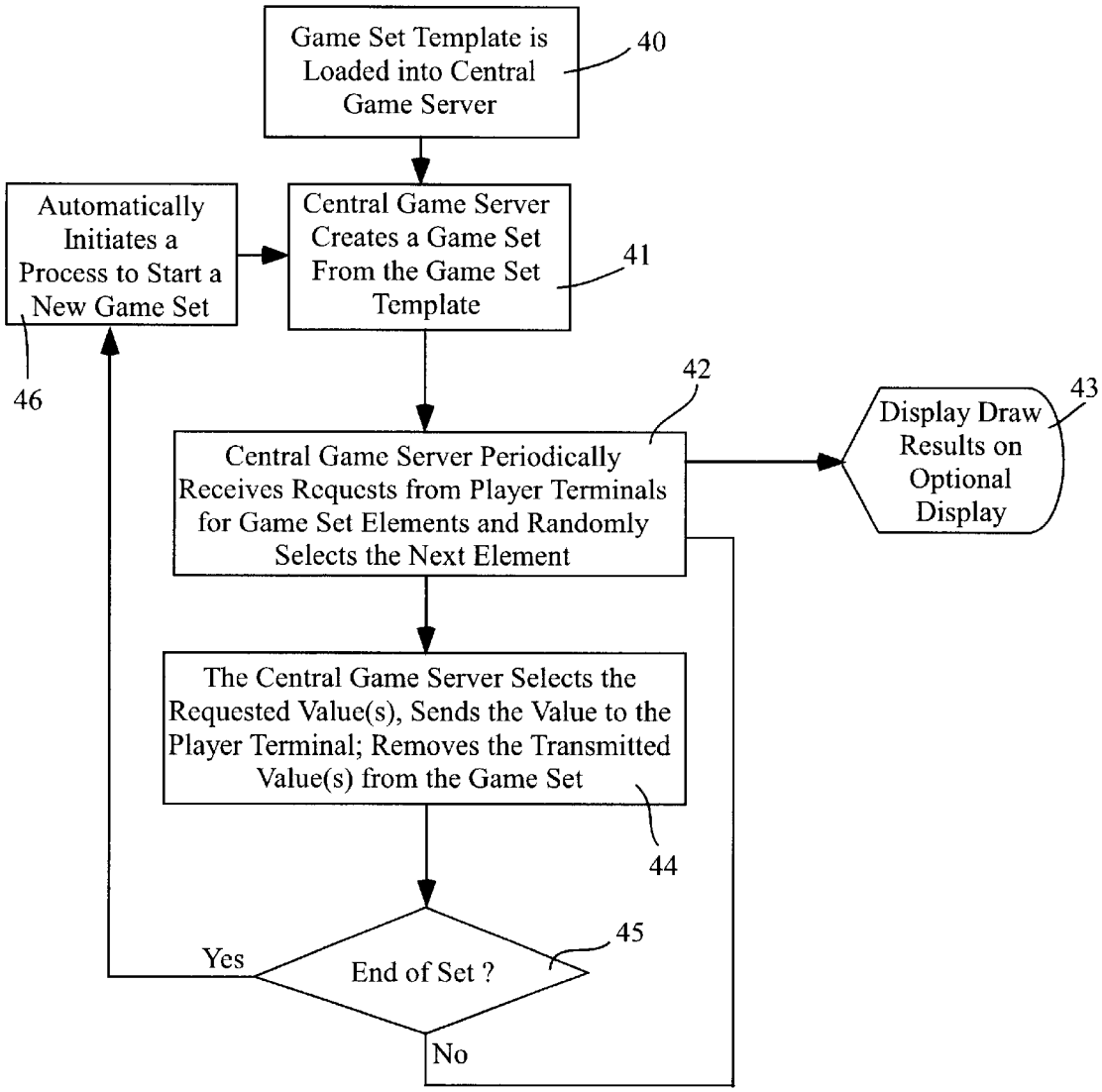
FIG. 4 provides a flow chart illustrating part of the programming of the central game servers, according to the present invention.

FIG. 4 provides a flow chart illustrating the programming of the central game servers. In block 40, a game set template is loaded into the central game server. The template is a set of data from which the server can create the game set elements to be used in the game. The server creates these elements in block 41, and stores them in its memory. Block 42 represents the operation of the central game server in receiving requests for game set elements, from the various player terminals, and in randomly selecting a game set element from the finite pool. Information on the game set element drawn from the pool may be shown on the optional display, indicated in block 43.

In block 44, the central game server sends the selected element to the player terminal, and removes that element from the finite pool. If the pool of game set elements is empty, the system automatically initiates the process of creating a new game set, in block 46. Otherwise, the program returns to block 42, the system being ready to accept the next request for a game set element.

Figure 7:
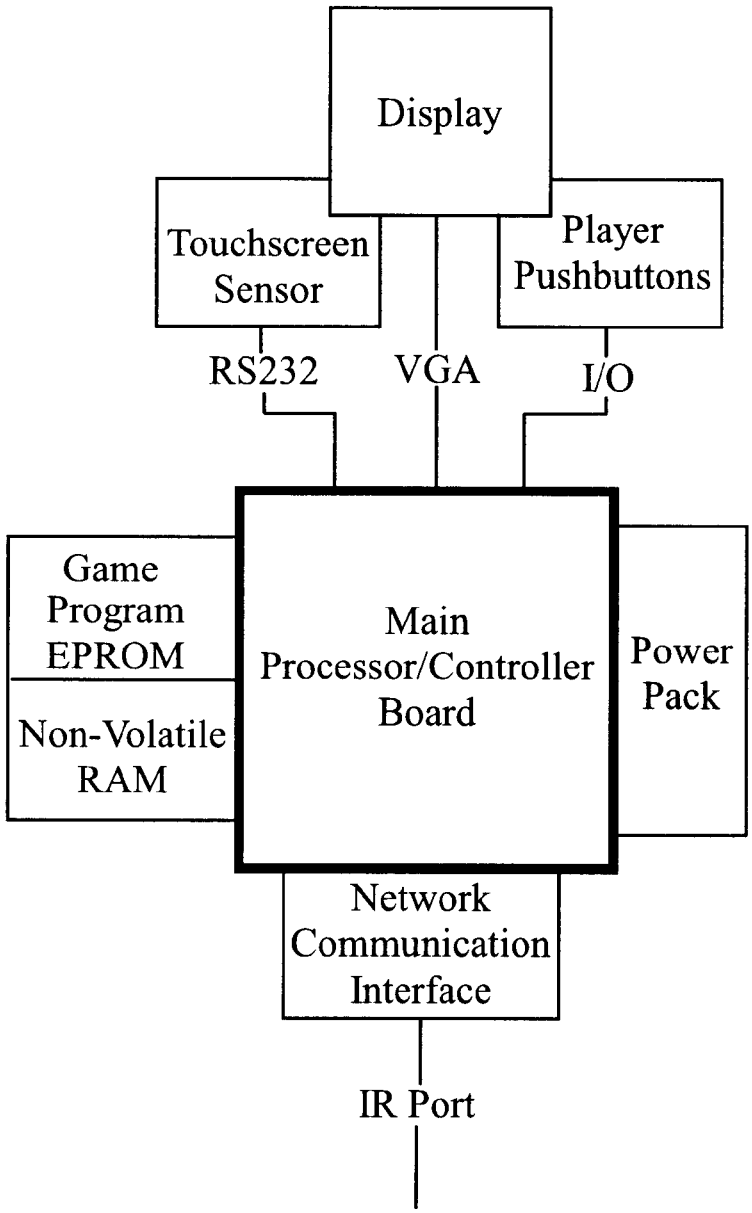
FIG. 7 provides a block diagram of a hand-held remote player terminal according to the present invention.

The present invention is not limited to use with networked terminals, but can be used with stand-alone terminals. Players could also use hand-held terminals, or terminals which are linked by wireless connections to a central server. FIG. 7 provides a block diagram of a hand-held remote player terminal, showing the main circuit board and the essential peripheral devices connected thereto. These variations do not affect the basic principle of operation. However, in the case of stand-alone terminals, the game set elements are not taken from a pool serving a plurality of player terminals, but would instead be provided in a local memory, at each terminal. In the case of hand-held terminals, the hand-held terminals could be stand-alone devices, or they could be continuously or intermittently linked to a central server by appropriate wireless or hard-wired means.

Figure 5:
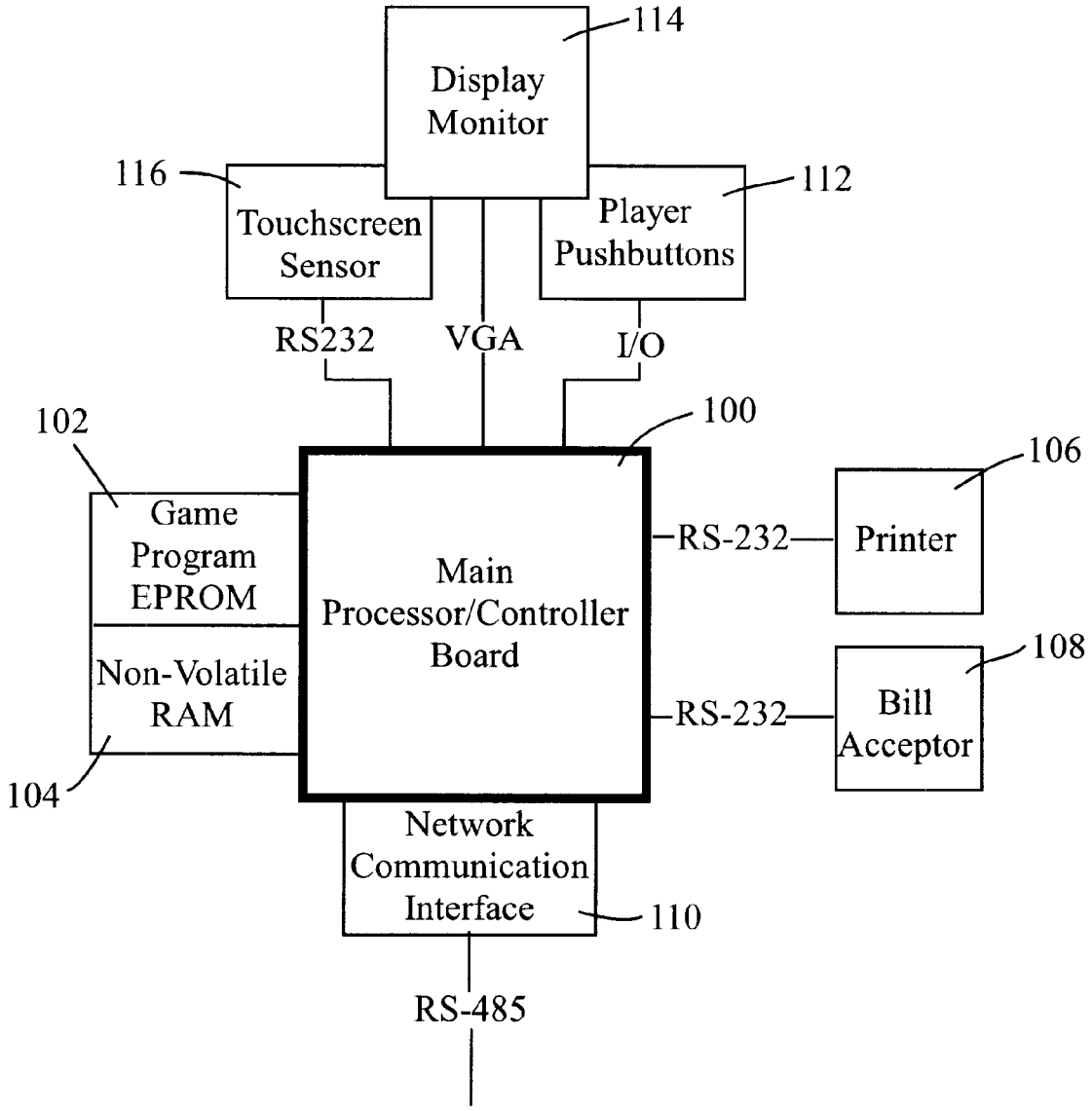
FIG. 5 provides a block diagram showing essential components of a player terminal according to the present invention.

FIG. 5 provides a block diagram showing the basic components of a typical player terminal. The essential component of the terminal is main processor/controller block 100. The main board receives input from the player through touch screen sensor 116 and/or player push buttons 112. The choices made by the player, and the results of the game, can be shown on display monitor 114. The program for the game can be stored on EPROM 102, and the main board preferably has access to non-volatile memory 104. The main board can also be connected to printer 106 and bill acceptor 108. A network interface 110 allows communication with other machines.

Many other variations of the hardware depicted in FIG. 5 are possible. For example, the printer and/or bill acceptor can be provided at a different location from the player terminal. The network communication interface can be replaced with a wireless connection, such as an infrared interface. The programming for the games could come from a central game server, rather than an EPROM attached directly to the terminal. These variations do not significantly affect the basic principles underlying the operation of the present invention.

As mentioned above, an important application of the present invention is in the game of lottery poker. The game to be described is a substantial improvement over a conventional game of video poker. Before describing the game of the present invention, it is helpful to review the operation of a conventional video poker game.

In a conventional video poker game, using direct mapping, the computer displays a pay table, showing the award to be made for each category, i.e. royal flush, straight flush, full house, etc. A typical pay table is shown in Table 4. This pay table applies to a five-credit game, since the minimum award (for Jacks or Better) is five units.

TABLE 4

| | |
|---|---|
| Royal Flush | 4000 |
| Straight Flush | 250 |
| Four of a Kind | 125 |
| Full House | 40 |
| Flush | 25 |
| Straight | 20 |
| Three of a Kind | 15 |
| Two Pair | 10 |
| Jacks or Better | 5 |

The system randomly "deals" five cards from a simulated deck, and displays these cards on a video monitor. The player must then decide which cards to hold, and which cards to replace with a new card randomly drawn from the deck. After the player has indicated his or her choices, the system draws the cards requested, and evaluates the new hand according to the pay table. The amount won, if any, is credited to the player's account, and the player can then begin the next play.

The above-described game clearly uses direct mapping, because the cards to be dealt are determined first, and then the final hand is evaluated according to the pay table.

In the reverse-mapped video poker game of the present invention, the maximum allowable award for a particular play is determined first. Then, subject to input received by the player, the system determines symbols (i.e. poker hands) which correspond to the amount to be awarded.

Figure 6:
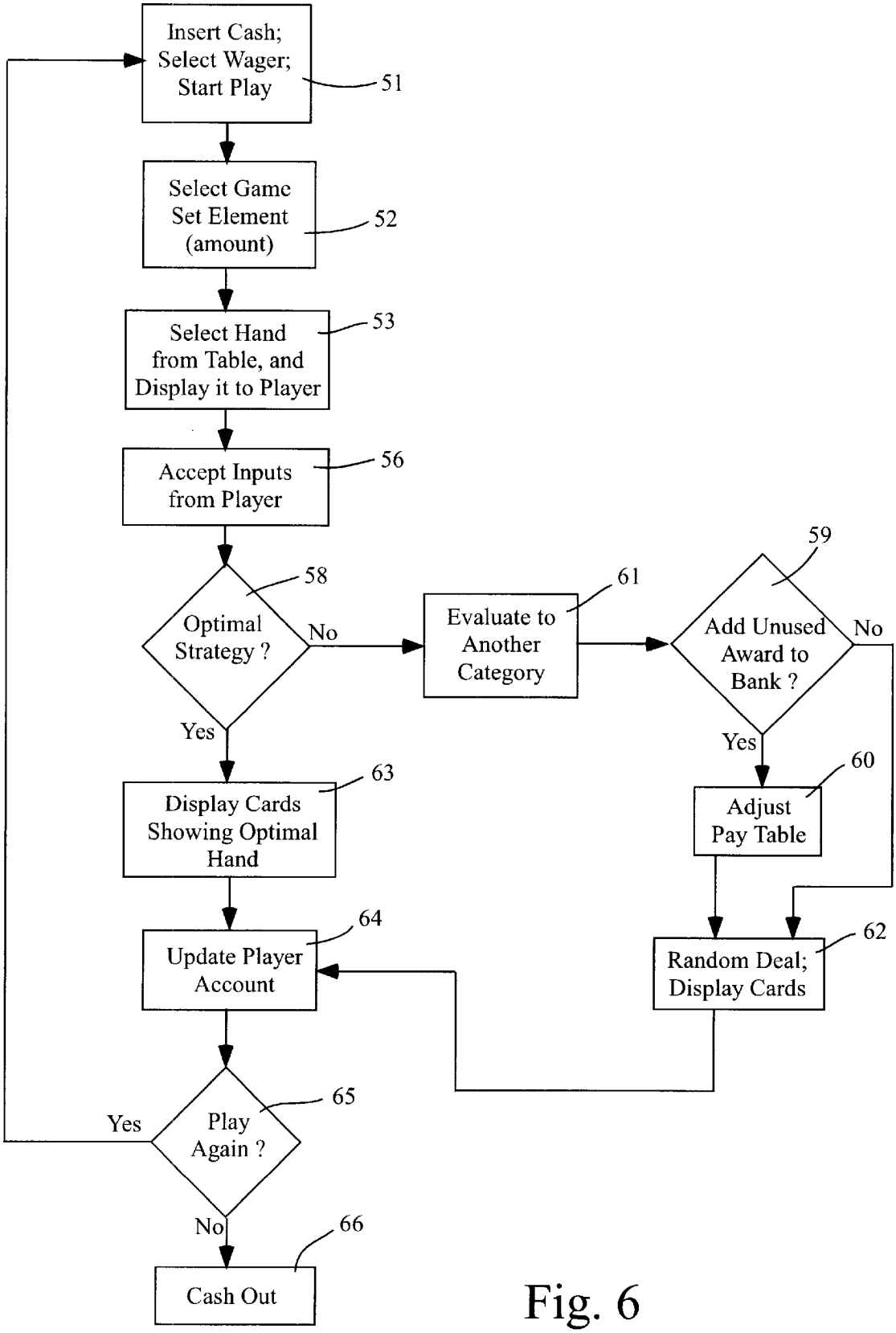
FIG. 6 provides a flow chart showing the programming of a lottery-type reverse-mapped video poker game, according to the present invention.

The essential programming of a reverse-mapped lottery poker game of the present invention is illustrated by the flow chart of FIG. 6. In block 51, the player inserts cash, or its equivalent, into the terminal, selects a wager, and starts the play, typically by pressing a button. In block 52, the system selects a game set element from a finite pool. Each game set element comprises a data element which represents a maximum potential amount to be awarded. Each such amount corresponds to a particular hand category, such as royal flush, straight, full house, etc. The selection can be performed randomly or sequentially, from among the game set elements. The pool contains a predetermined number of game set elements for each category; the greater the value of the category, the fewer the elements in the pool corresponding to that category. For example, the number of royal flushes in the pool should be far smaller than the number of straights.

To each amount which the player can win on a particular play, there is associated a table of poker hands which can be dealt. The hands in each table are chosen such that if any such hand is presented to the player, and if the player plays in an optimal manner, the player will be able to achieve the category corresponding to the maximum possible award amount. In general, a particular hand may be listed in more than one table, because a given hand may be played differently to yield different final results.

In block 53, the system selects a hand from the table corresponding to the amount determined in block 52, and displays the selected hand to the player. The system also displays a pay table to the player, so that the player will know the award obtainable for each category.

In block 56, the system accepts inputs from the player. The player must indicate (such as by pressing buttons or clicking a mouse) which cards should be held, and which cards should be replaced by a new card drawn from the deck. Thus, if five cards are dealt to the player, the player must make five decisions, i.e. the player must decide, for each card, whether to hold that card or draw a replacement.

For each possible hand of poker, and depending on the pay table showing the awards to be won for each category, there is an optimal strategy which can be calculated using elementary principles of combinatorics. The following example shows how this calculation can be performed.

First, assume that the pay table showing the awards for various categories is as follows:

| | |
|---|---|
| Royal flush | 800 |
| Straight flush | 50 |
| Four of a kind | 25 |
| Full house | 9 |
| Flush | 6 |
| Straight | 4 |
| Three of a kind | 3 |
| Two pairs | 2 |
| One pair Jacks or better | 1 |

The pay table shown above means that for a wager of one unit, a royal flush returns 800 units, etc. The pay table is chosen arbitrarily at the outset. As will be apparent from the following discussion, the optimal strategy depends critically on the pay table.

Now, suppose that the hand dealt to the player is as follows:

King of Clubs
King of Hearts
Queen of Hearts
Jack of Hearts
Ten of Diamonds

There are 32 ways to play any five-card hand, as shown below:

| | |
|---|---|
| Hold all cards or discard all cards | 2 ways |
| Discard 1 card | 5 ways |
| Discard 2 cards | 10 ways |
| Discard 3 cards | 10 ways |
| Discard 4 cards | 5 ways |

Each of the above ways comprises a possible strategy. For each such strategy, one can calculate an expected return. The "optimal" strategy is then the strategy having the greatest expected return.

In the example given above, suppose that one wishes to compute the expected return achieved by holding only the King of Hearts, the Queen of Hearts, and the Jack of Hearts, and by drawing two new cards. The number of ways of drawing two cards from a deck of 47 cards (i.e. 52 cards less the original five cards dealt) is obtained by elementary combinatorics as (47!)(46!)/2!, which is 1081. Thus, the probability of obtaining each new hand is 1/1081.

The number of ways of obtaining a royal flush, for the cards held, is one, so the probability of obtaining a royal flush is 1/1081.

The number of ways of obtaining a straight flush, for the cards held, is also one, so the probability of obtaining a straight flush is also 1/1081.

The number of ways of obtaining either four of a kind or a full house is zero, because neither category can be constructed with the three cards held. Thus, the probability of obtaining four of a kind or a full house is zero.

The number of ways of obtaining a flush, but not a royal flush or a straight flush, is 43 (45 ways of drawing two cards of the same suit, less the royal flush (1), less the straight flush (1)). Thus, the probability of obtaining a flush is 43/1081.

In similar fashion, one can determine, by combinatoric principles, i.e. by computing the number of ways of drawing cards, that the probabilities of obtaining a straight, three of a kind, two pairs, and one pair Jacks or better, are 22/1081, 7/1081, 21/1081, and 318/1081, respectively. In computing the number of ways of drawing cards, one must take into consideration the cards that have been dealt and/or discarded, and thus removed from the deck. In general, the probability of obtaining a particular category is the number of ways of executing the selected strategy in a manner which yields that category, divided by the total number of ways of executing that strategy.

The expected return obtained from the above-mentioned strategy is computed by multiplying each pay table result by the probability of achieving that result. For the above example, the expected (mean) return is:

$$(1/1081)(800)+(1/1081)(50)+(43/1081)(6)+(22/1081)(4)+(7/1081)(3)+(21/1081)(2)+(318/1081)(1)=1.459$$

That is, if the player plays the above strategy many times, the expected return for a wager of one unit will be 1.459 units.

In a similar manner, one can compute the expected return for each of the other 31 ways to play the given hand. One therefore derives a set of 32 numbers, comprising the expected returns from each way of playing the hand. The strategy having the greatest expected return is defined as the optimal strategy for that hand.

Since the expected return is essentially a weighted average of the pay table amounts, the optimal strategy, in the above example, depends critically on the pay table.

It is clear that the above-described computation can be repeated for every possible initial hand. That is, for each possible hand, one can calculate the expected return from each of the 32 ways of playing that hand, and can determine the optimal strategy by selecting the strategy having the greatest expected return.

In summary, for each possible hand, and given a pay table, there is an optimal strategy, i.e. a strategy which maximizes the expected return to the player.

The invention is not limited to the use of the particular procedure described above. It is also possible to use other criteria for determining the "optimal" strategy. For example, one could define as "optimal" the strategy which maximizes expected return and minimizes variability of return. One could define optimal strategies in still other ways, and these ways could be partially or completely independent of the concept of expected or average return. It is even possible to predefine an "optimal" strategy without regard to the pay table, and without regard to what is optimal in the mathematical sense. It is only necessary that the system be able to compare the performance of a player with a stored table representing an "optimal" strategy. The present invention is intended to include all of the latter alternatives.

When the optimal strategies have been derived in the manner described above, the results are stored in a computer memory. In the preferred embodiment, the memory of the computer includes a table which shows the optimal strategy for every possible hand. Thus, by electronically examining the table, and by comparing the optimal strategy with the decisions actually made by the player, the system can determine whether or not the player's choice was optimal.

The system performs this table lookup in test 58, to determine whether or not the player's choice was optimal. If the choice was optimal, the system continues in block 63. In block 63, the system must "fill" the player's order, i.e. it must replace those cards, which the player wants to replace, with cards from the remainder of the deck. It must do so while giving the player a final hand corresponding to the optimal hand determined earlier. This process is simple, because the system can simply fill the player's order with cards which make the final hand identical to the optimal hand stored in memory. The modified hand that is displayed in block 63 is also known as the "resulting draw",because it includes the cards drawn as the result of the player's decisions on which cards to hold and which cards to draw.

The system then credits the player's account in block 64, and gives the player, in test 65, the opportunity to stop the game (block 66) or play another hand (return to block 51).

Now suppose that the player's strategy was sub-optimal. The system must next determine an amount to be awarded to the player. In block 61, using the choices made by the player, the system determines the cards that generate a hand belonging to another category, other than the optimal category. In one preferred embodiment, the system generates a hand which comprises the next most valuable category following the optimal category. For example, if the pay table is as shown in Table 4, and if the system had chosen (in block 52) the category "full house" as the category available to the player, then if the player performs sub-optimally, the system would then look for cards (in fulfillment of the player's choices) which produce a flush, which is the next highest category following a full house. However, if the player's choices make it impossible to recreate the next highest category with the cards available, the system would then be programmed to look for cards which correspond to the next category in the hierarchy (in this case, a straight), and so forth.

In another embodiment, the system need not be limited to evaluating to the next highest category. Instead, the system could choose from among several (or all) categories, according to a predetermined probability. Thus, if the player performs suboptimally, the system can be programmed to select another category according to any probability distribution, and award an amount to the player corresponding to that category. In the most general case, it is even possible to select a more valuable category than the one which the player failed to achieve. That is, it is possible to award the player a greater award than if the player had played optimally. The latter alternative further enhances the entertainment value of the game.

In another variation of the video poker game, suppose that the system awards the maximum amount only if the player performs optimally. Thus, if the player's choices are sub-optimal, the program will award the player an amount which is less than the maximum amount. In making this award, the system can be structured in at least two different ways. One way is simply to award the player an amount which is less than the maximum amount, without doing anything further. Another, more interesting way is to award the player less than the maximum amount, and to place the difference into one or more "banks" to be used to fund future awards. The concept of funding an award bank can also be applied in the case described above, wherein the award is made according to a predetermined probability distribution.

Thus, in test 59, the system determines whether the un-awarded sum is to be added to the bank. If so, the system will add the difference between the maximum achievable amount, for the previous play, and the amount actually won by the player, to the bank. This step may be accomplished simply by adjusting the pay table, in block 60. One simple way of doing so is to add the un-awarded sum to the available award for the most valuable category (royal flush). Another way of doing so is to distribute this sum across several categories, preferably two or more of the most valuable categories. When the pay table has been adjusted, the player will automatically see the revised pay table on the next play.

Next, the selected sub-optimal hand (or, in the more general case, the non-optimal hand) is displayed to the player, in block 62. The program then continues with block 64, as before.

The game described above is clearly a lottery, because it operates with a fixed pool of awards, selected in block 52. The game can be practiced in the networked environment described above, wherein the central game servers, or lottery gaming controllers, store the game set elements and distribute those elements to the various player terminals upon request.

The game described above is also an example of reverse-mapping, because the maximum outcome of each play is determined first, and the hand that corresponds to this outcome is determined later. Moreover, the mapping is not one-to-one, because there are a plurality of hands belonging to each category.

The invention is not limited to use with simulated slot machines or video poker. The same concepts can be applied to many other kinds of games, such as video black jack, roulette and other wheel games, and others.

The principles of the invention, discussed above, can be extended further to create even more varied and entertaining games. The following paragraphs describe additional ways in which games can be created using the reverse-mapping of the present invention. All of the following cases can be practiced with either lottery or non-lottery games, and with games of pure chance, as well as with games involving an element of skill.

Consider the following Table 5, which comprises a pay table for a conventional game:

TABLE 5

| Symbol | Award |
|---|---|
| 777 | 25 |
| BBB | 10 |
| PPP | 5 |
| 000 | 2 |
| CCC | 1 |
| Mixed | 0 |

This is a typical slot machine game, in which the player wins the award shown in the second column, if the machine generates the corresponding symbol in the first column. As before, the amount of the award is in arbitrary units. For example, if the wager is one dollar, and if the machine generates "777", then the player wins 25 dollars.

Consider now what happens when the rules of the game allow a player to wager a double bet. In a conventional game, if the player wagers two dollars, and if the machine generates "777", the player will win exactly 50 dollars. That is, the awards are simply multiplied by an integral factor corresponding to the size of the wager. The two-credit game is no more entertaining than the one-credit version, except that the wagers and awards are doubled.

In the reverse-mapping system of the present invention, by contrast, the above-described two-credit game becomes much more interesting. In a two-credit lottery game, wherein the player wagers double the basic amount, the system selects two awards from the available pool, and adds these awards together. Then, the system reverse-maps this sum to an appropriate symbol display. Thus, in one embodiment, the two-credit version of the game represented by Table 5 will not resemble Table 5, but instead has possible awards which are 50, 35, 30, 27, 26, 25, 20, 15, 12, 11, 10, 7, 6, 5, 4, 3, 2, 1, and zero. The latter numbers are the awards which can be obtained by drawing two numbers, sequentially and independently, from the second column of Table 5. (Note that one or both of the awards drawn could be zero, and the same award could be drawn twice.) The maximum award, 50, occurs when the system draws "25" twice; the next highest award, 35, occurs when the system draws a "25" and a "10", etc.

After calculating the award. the system reverse-maps the award to an appropriate symbol which is displayed to the player.

The above-described game need not be limited to a two-credit play. Even with a standard pay table and a single credit play, a "25" could result in two awards of "10", and one award of "5", in a multiple-award display sequence.

However, it will be appreciated that not every combination of two awards will necessarily be represented in a pay table displayed to the player. If the selected combination is not in the pay table seen by the player, the system can be programmed to award the highest amount available, consistent with the awards drawn, and to use the balance to fund a special bonus, a progressive prize, and/or a "mystery pay". For example, if the pay table displayed to the player shows possible awards of 50, 25, 10, and 0, and if the sum of the two awards drawn is 35, the system will award 25 to the player (because 25 is the highest award in the pay table consistent with the awards drawn), and will place the remaining 10 credits in a special fund. Instead of a special fund, the system could provide the player with a secondary "free" spin which will provide the remainder of the award amount. Thus, for example, if the award amount is 35, a "777" could be displayed and pay 25, followed by an automatic or player-initiated secondary spin which displays "BBB" and pays 10, for a total award of 35.

The special fund could be used for predetermined or reverse-mapped bonus or special award play combinations, which may allow the player an additional play without the need to insert more money.

The system could be programmed to distribute the bonus to a player after a predetermined number of plays on the machine. That predetermined number of plays could be fixed (e.g. a bonus may be distributed after, say, every fifty plays), or it could be variable. Thus, the interval between awards of bonus plays can be made to vary. The length of the interval could be determined by a random or pseudo-random process, or by some other algorithm.

Alternatively, the special fund could be used to build up a progressive award, which is also awarded to a player after a predetermined number of plays, or after some random or pseudo-random number of plays.

In all of the embodiments of the present invention, it is possible to distribute un-awarded amounts to a plurality of separate funds used to provide progressive or bonus awards. An un-awarded amount could be divided equally among several such funds, or it could be divided according to any other scheme.

In still another alternative, the special fund could provide a "mystery pay" which distributes money to a player, on a random basis. The mystery pay could be distributed after a predetermined number of plays, or after a randomly determined number of plays. The amount distributed could be the entire amount of the fund, or some fixed or randomly-determined portion thereof.

In a particular embodiment, the system could be programmed to distribute all or part of the special fund after a predetermined number of consecutive losing plays. For example, the system could be programmed to distribute an award, from the special fund, if a player has lost ten plays in a row. The number of losing plays required could itself be a variable number, produced by a random number generator, or by other means. So the interval between special awards could be made to vary in an unpredictable manner.

It should be appreciated that, while the above-described methods produce a game which is exciting and unpredictable, from the point of view of the player, the amounts ultimately paid out to players are the same as in a conventional game. Indeed, from the point of view of the operator of the game, the games provide the operator with the same expected return as with a conventional game. Also, the games of the present invention can be easily set to provide whatever overall payout ratio is desired, simply by adjusting appropriate software parameters.

The above-described two-credit game applies both to lottery and non-lottery games. In the case of a lottery, the system simply draws two awards from the finite pool. In a non-lottery game, having a theoretically infinite pool of awards, the system calculates two plays, using the same probability distribution, and adds the awards obtained from both plays to yield an aggregate award. In both cases, if this aggregate award is found in the pay table shown to the player, the award is reverse-mapped to an appropriate symbol to be displayed. If the computed award is not found in the table, the player receives the highest available award consistent with the computed award, with the balance being directed to a special fund.

The two-credit game described above can comprise a game of pure chance, or it can be a game having an element of skill. If the game has an element of skill, the player may affect the amount awarded by playing optimally, as described earlier. It is also possible for the system to withhold a portion of an award, even where the player performs optimally, and to deposit the withheld portion into a special fund.

Clearly, the above discussion can be generalized to allow other multiple-credit games, such as three or four-credit games, using the same principles. From the above discussion, it is clear that these games will differ from each other, much more so than multiple-credit games of the prior art.

In all of the games which require selection of two or more game set elements from a finite pool, the selections can be performed in a random manner, such as by drawing a game set element at random from the pool. Alternatively, the selections can be made sequentially, i.e. by selecting two or more game set elements which are "adjacent" to each other in the computer memory. Also, the selections of game set elements can be independent, i.e. the selection of one game set element is independent of the selection of another game set element.

In the above examples, games involving skill have been described in terms of an optimal strategy. However, the invention can be generalized to include games in which the player wins an award by selecting some predetermined strategy, which strategy may not necessarily be optimal. The game would otherwise be played in the same manner as described earlier.

In another variation, instead of awarding a maximum amount if the player selects a predetermined (or optimal) strategy, and a lesser amount otherwise, the system may be programmed simply to reduce the probability of obtaining the maximum amount in the event that the player does not select the correct strategy. In this case, there would be a plurality of possible awards, each one associated with a probability, and one award would be selected accordingly. In a more general case, the system could even be programmed to award an amount greater than the original maximum amount (such as by awarding a prize from an accumulated award bank), with a predetermined probability. The latter variation adds considerable excitement and unpredictability to the game.

Another significant aspect of the invention is its ability to generate a plurality of games which, in appearance, are entirely different from each other, but which games are derived from the same game set. Tables 6, 7, and 8 represent different games that are derived directly from the basic pay table shown in Table 5. The games associated with these tables are described in the following paragraphs.

TABLE 6

| Symbol | Award |
|---|---|
| 777 | Progressive + 25 |
| BBB | 9 |
| PPP | 4 |
| 000 | 1 |
| CCC | 1 |
| Mixed | 0 |

Table 6 represents a one-credit game. In Table 6, the highest possible outcome is an award of 25 credits plus the balance in a progressive fund. The latter outcome is mapped to the symbol "777" . The other possible outcomes are 9, 4, 1, and 0. Note that the outcomes 9, 4, and 1 are obtained by subtracting one from each outcome in the corresponding positions of Table 5. While the game shows, to the player, the outcomes 9, 4, and 1, in reality the system awards 10. 5, and 2, and deposits the additional credit into the progressive fund. The player does not know that one credit has been "withheld" and deposited. In this example, there is no contribution made to the progressive fund for the outcome "1" associated with the symbol "CCC".

Thus, it will be apparent that the game represented by Table 6 is really the same game as that shown in Table 5, in that the system makes the same awards, with the same overall payout ratios, and with the same probabilities. The difference between these games is in how and when the awards are distributed. In a fundamental sense, one can say that the game of Table 6 is derived from that of Table 5.

In the example of Table 6, there is only one symbol associated with some of the outcomes. The use of one symbol is for clarity of illustration; in general, there will be more than one such symbol, as a given outcome may be reverse-mapped to any of several different symbols, as explained above.

Table 7 shows a two-credit game which is also derived from Table 5, which comprises a game of Keno, in which players attempt to select winning combinations of numbers arranged on a grid.

TABLE 7

| Hits | Award |
|---|---|
| 18 of 18 | 50 |
| 17 of 18 | 35 |
| 16 of 18 | 30 |
| 15 of 18 | 27 |
| 14 of 18 | 26 |
| 13 of 18 | 25 |
| 12 of 18 | 20 |

TABLE 7-continued

| Hits | Award |
|---|---|
| 11 of 18 | 15 |
| 10 of 18 | 12 |
| 9 of 18 | 11 |
| 8 of 18 | 10 |
| 7 of 18 | 7 |
| 6 of 18 | 6 |
| 5 of 18 | 5 |
| 4 of 18 | 4 |
| 3 of 18 | 3 |
| 2 of 18 | 2 |
| 1 of 18 | 1 |

Table 7 shows the awards associated with each possible number of "hits" made by the player. The awards comprise combinations of two awards taken from Table 5, because the game is a two-credit game. For example, if system selects 25 and 25, the award is 50. If the system selects 25 and 10, the award is 35, and so on. Thus, the game represented by Table 5 is used to create a Keno game which has a completely different outward appearance, but which nevertheless uses the same game set. As before, one can construct the game such that each outcome is reverse-mapped into any of a plurality of display symbols.

Table 8 shows still another example of a game derived from Table 5. In Table 8, the game is again played with two credits, and there is a base game and a bonus wheel play.

TABLE 8

| Base Game Play | | Bonus Wheel Play | |
|---|---|---|---|
| Symbols | Award | Symbols | Award |
| 777 | 25 | 777 | Progressive + 25 |
| BBB | 10 | BBB | 9 |
| PPP | 5 | PPP | 4 |
| 000 | 2 | 000 | 1 |
| CCC | 1 | CCC | 1 |

The base game play is the same as for the one-credit game represented by Table 5. But since this is a two-credit game, the system draws another award, using the pay table shown at the right-hand side of Table 8. The pay table on the right-hand side is the same as that of Table 6. and this portion of the game works in the same way. The system displays the result of a bonus play, and deposits unused credits into a progressive fund. Thus, the resulting game is different from any of the other games previously described, although it is still derived from the same basic pay table shown in Table 5.

In all of the above examples, the game set does not include any information regarding the symbols displayed to the player, because many symbols and award outcomes are possible, based on the particular game set element that was selected.

Thus, the player terminal can provide many game variations, which are independent of a fixed and predetermined set of outcomes that comprise a game set.

In still another variation of the present invention, awards from different game sets can be selected and added together. For example, in a two-credit game, the system can select awards from two different game sets, add them together, and reverse-map the result to a symbol displayed to the player. Part of the resulting award may be withheld and deposited to a fund used to support bonus plays etc., as described above. The different game sets could be stored in the memory of a particular player terminal, or they could be game sets maintained by a central game server which provides game set elements to various terminals upon request. Games derived by adding awards from two or more different game sets clearly have even greater potential for variety and entertainment value, than the games created by selecting two or more elements from the same game set.

The selections of multiple awards from the same or different game sets comprise independent probability events. That is, when two or more game set elements are to be selected, the system selects each one according to a particular probability distribution (which, in the case of a lottery, may be variable as the number of game set elements changes), each selection being statistically independent of the previous selection.

In general, and regardless of the type of game, when two or more awards are selected by the system, these awards are added internally to form an intermediate sum, and a predetermined value may be subtracted from this intermediate sum to produce an award which is displayed and paid to the player. The predetermined value is then added to a separate fund which is used to support other awards, as described above. The player does not see the intermediate value, and is therefore not aware that the system deducted part of his or her potential award and deposited it into the special fund. Note also that, in one special case, the predetermined value may be set always to zero, in which case there is no fund for bonus awards.

The invention can be modified further by including, in the game sets, certain triggering event designators. In this case, the game set elements may include data in addition to, or instead of, an amount of an award. For example, the game might include bonus plays or progressive plays which are triggered when a selected game set element includes a flag which tells the system to award a special bonus. When such an element is selected, its value may be determined either by a predetermined fixed bonus, or by a progressive fund created from accumulated contributions of other players, and that element is reverse-mapped to an appropriate symbol or symbols as before. Also, if the system selects a game set element which identifies a bonus, the player can be awarded all or part of a stored bonus fund.

In general, a game set element may reverse-map to a single fixed award, or it could reverse-map to an initial award and a series of subsequent bonus awards. Also, one could obtain a bonus award without necessarily drawing a game set element that is coded with a designator described above.

A simple example of a multiple award sequence is as follows. Suppose that, on a particular play, the system determines that the player will win 10 units. Suppose further that the possible awards are 1, 2, 3. 5, or 10. The system could display a symbol which corresponds to the award of 10. The player would be paid, and the game would be over. Alternatively, the system could display one of the lesser awards, and could give the player one or more "free" chances to play. On each subsequent "free" play, the player would win another award, such that when the sequence is over, the player would have won a total of 10 units. This award sequence could be automatic, or it could require the player to provide input, such as by pressing a button to start each new play. In any case, the total amount awarded is the same as before, but in the latter alternative, the player receives the award in several packages, through the bonus play sequence described.

The concept of multiple award sequences can be incorporated into any of the embodiments of the invention described above. An award can be made in one lump sum, or in a series of steps.

Another important advantage of the reverse-mapped game of the present invention is that the game can be very easily modified. For example, one can change the character of the game by changing the probabilities of obtaining each possible outcome. This change can be accomplished directly, without the need to make changes in the symbols. In effect, the present invention allows the operator to build a new slot machine without having to construct new wheels. The "new" machine is created simply by modifying software parameters. The present invention therefore makes it possible to build an enormous variety of games, using the same hardware, and with minimal effort to make each change.

The number of games that can be played with the present invention is virtually limitless. Whereas the typical lottery "scratcher" game, or pull tab game, is limited to a particular format, and to fixed award and display outcomes, the present invention can generate games of much greater variety. The present invention can produce multi-level bonus games, such as second-chance bonus wheel games, games of skill such as video poker or video black jack, games with a variable number of game set elements applied to a single play, such as a variable-bet game which allows the player to wager a different amount on each play, and progressive games as described above.

The invention is not limited to a particular form of display mechanism. The displays can be spinning reel displays, video monitor displays, wheel displays, dot matrix LED displays, vacuum fluorescent displays, or combinations of the foregoing, to enhance the entertainment level of the player terminal.

In the embodiment of the invention wherein a plurality of player terminals are connected by a network, the same game set could be used for different games played on different terminals in the network. For example, one terminal might support a 1–3 credit game, while another terminal might support a 1–5 credit game, while both terminals derive their game set elements from the same pool, such as a pool located in a central game server. Alternatively, a single game set could be used to operate different games on a single stand-alone terminal.

In general, any terminal programmed according to the present invention may include the capability of splitting an award into a base game outcome and a bonus play outcome, or of withholding a portion of a basic award and depositing the withheld portion into a fund which provides for progressive awards or mystery pays. A game may have two independently-funded prize structures. For example, the game may have a one-dollar total wager required to play, with two cents of each wager being used to fund an accumulating fund, the remainder being directed to the basic game. The latter withholding could be practiced whether or not the game is a lottery, and whether or not the game involves an element of skill which affects the award to the player.

The present invention also includes another form of video lottery poker, described in the following paragraphs. This video poker game includes two phases, effectively giving the player two chances to win, the first based on a hand of cards initially dealt, and a second chance based on the game strategy chosen by the player.

In the first phase of the video lottery poker game, the system effectively "deals" an initial hand, by selecting a game set element from a pool of game set elements, each game set element representing a possible hand. If the game set element (i.e. the hand dealt to the player) corresponds to one of a plurality of particular winning categories, the player wins, an award is made, and the game is over. An award is then made to the player according to a predetermined pay table.

An example of a possible pay table for this game is as follows:

| | Weight | Pay |
|---|---|---|
| Royal Flush | 4 | 250 |
| Straight Flush | 36 | 50 |
| Four of a Kind | 624 | 25 |
| Full House | 3744 | 8 |
| Flush | 5108 | 6 |
| Straight | 10200 | 4 |
| Decision Hands | 2579244 | |
| Total | 2598960 | |

The first six rows of the pay table shown above define the categories which immediately win an award, i.e. royal flush, straight flush, etc. The weights for each category represent the number of ways to produce each category from a regular 52-card deck. These weights, when divided by the total number of possible hands, comprise the probabilities of obtaining each category.

The right-hand column represents the payout for each category. Thus, if a player wagers one unit, and obtains a royal flush, the award is 250 units, etc. The amounts in the pay table can be chosen arbitrarily by the operator of the system.

The weightings indicated for the pay table shown above are implemented by providing a pool of game set elements in which the number of elements representing a particular category is proportional to the probability of obtaining that category. For example, there are four ways of obtaining a royal flush, 36 ways of obtaining a straight flush, etc. The numbers of game set elements corresponding to a royal flush, straight flush, etc. are selected to be in proportion to the weights shown, i.e. 4, 36, 624 etc. When the system draws a game set element from an undepleted pool, the probability of obtaining a particular result will be in proportion to these weights. Note, however, that after a game set element is withdrawn from the pool, the probability of obtaining a particular result on a subsequent play is slightly altered, due to depletion of the pool. But when the game is played many times, and especially when the pool is periodically replenished, the overall probability will be in close accord with the theoretical value.

Note also that, instead of assigning weights to each hand based on the actual probability of obtaining such hand, the weights shown in the table could be arbitrarily selected, and could be entirely unrelated to the theoretical probability. In this case, the weights can be controlled simply by choosing the number of game set elements, present in the pool, for each category. The mechanics of the game are otherwise the same, though the results will differ from that based on actual probabilities.

If the initial hand that is dealt, i.e. the game set element drawn from the pool, does not correspond to one of the six winning categories shown in the pay table, the hand is said to be a "decision hand". A decision hand is one in which the player is given an opportunity to play, i.e. to decide whether to hold or draw cards. In the example given above, there are 2,579,244 such decision hands. Thus, the sum of the weights shown in the table is 2,598,960, which is the number of five-card hands that can be drawn from a 52-card deck.

If the player receives a decision hand, i.e. if the player "loses" on the initial play, the player is given an opportunity, in effect, to play again, i.e. to replace one or more cards of the hand. The player indicates to the system, by pushing appropriate buttons, or by other equivalent means, which cards to hold and which ones to discard. After receiving the decisions of the player, the system selects one of a plurality of "decision pools" which collectively summarize all of the possible situations that can be encountered by a player, and all of the possible strategies that can be selected by the player. Another game set element is then drawn from the selected decision pool. Before explaining this second card-drawing process, it is important to understand the structure of the decision pools.

One example of a set of decision pools is illustrated in the following tabulation. The notation used in the table will be explained immediately thereafter.

1. 4C RF, A-J, FLUSH
2. 4C RF, A-J, STRAIGHT
3. 4C RF, A-J, PAIR
4. 4C RF, A-J
5. 4C RF, A-10, FLUSH
6. 4C RF, A-10, STRAIGHT
7. 4C RF, A-10, PAIR
8. 4C RF, A-10
9. 4C RF, K-10, FLUSH
10. 4C RF, K-10, STRAIGHT
11. 4C RF, K-10, PAIR
12. 4C RF, K-10
13. 4C SF, Q, J,10,9
14. 4C SF, J,10,9,8
15. 4C SF, 10 or below
16. 4C FL, 3 high cards
17. 4C FL, 2 high cards
18. 4C FL, 1 high card
19. 4C FL
20. 4C ST, 3 high cards
21. 4C ST, 2 high cards
22. 4C ST, 1 high card
23. 4C ST
24. 3 of a kind
25. 2 pair
26. 1 paying pair
27. 1 small pair
28. 3C RF,AKQ,AKJ,AQJ
29. 3C RF,KQJ
30. 3C RF,AK10,AQ10,AJ10
31. 3C RF,KQ10,KJ10
32. 3C RF,QJ10
33. 2C RF,AK,AQ,AJ
34. 2C RF,KQ,KJ
35. 2C RF,QJ
36. 2C RF,A10
37. 2C RF,K10
38. 2C RF,Q10
39. 2C RF,J10
40. AKQJ
41. KQJ
42. 2 high cards, 1 high card discarded
43. 1 high card,A
44. 1 high card,K
45. 1 high card,Q
46. 1 high card,J
47. Redraw
48. 1 paying pair with 1 card held
49. 1 paying pair with 2 cards held
50. 1 small pair with 1 card held 51. 1 small pair with 2 cards held
52. 3 of a kind with 1 card held
53. 3C ST,0H,2 high cards
54. 3C ST,0H,1 high card
55. 3C ST,0H,0 high cards
56. 3C ST,1H,2 high cards
57. 3C ST,1H,1 high card
58. 3C ST,1H,0 high cards
59. 3C ST,2H,2 high cards
60. 3C ST,2H,1 high card
61. 3C ST,2H,0 high cards
62. 3C ST,3H,2 high cards
63. 3C ST,3H,1 high card
64. 3C ST,3H,0 high cards
65. 2C ST,0H,1 high card
66. 2C ST,0H,0 high cards
67. 2C ST,1H,1 high card
68. 2C ST,1H,0 high cards
69. 2C ST,2H,1 high card
70. 2C ST,2H,0 high cards
71. 2C ST,3H,1 high card
72. 2C ST,3H,0 high cards
73. 2C ST,4H,1 high card
74. 2C ST,4H,0 high cards
75. 3C FL,0H,2 high cards
76. 3C FL,0H,1 high card
77. 3C FL,0H,0 high cards
78. 3C FL,1H,2 high cards
79. 3C FL,1H,1 high card
80. 3C FL,1H,0 high cards
81. 3C FL,2H,2 high cards
82. 3C FL,2H,1 high card
83. 3C FL,2H,0 high cards
84. 3C FL,3H,2 high cards
85. 3C FL,3H,1 high card
86. 3C FL,3H,0 high cards
87. 2C FL,0H,1 high card
88. 2C FL,0H,0 high cards
89. 2C FL,1H,1 high card
90. 2C FL,1H,0 high cards
91. 2C FL,2H,1 high card
92. 2C FL,2H,0 high cards
93. 2C FL,3H,1 high card
94. 2C FL,3H,0 high cards
95. 2C FL,4H,1 high card
96. 2C FL,4H,0 high cards
97. 4C ST,1H,3 high cards
98. 4C ST,1H,1 high card
99. 4C ST,1H,1 high card
100.4C ST,1H,0 high cards
101.4C,2H,3 high cards
102.4C,2H,2 high cards
103.4C,2H,1 high card
104.4C,2H,0 high cards
105.1C,small The meaning of the above notation is as follows:

Pool No. 1 means that the player has received four cards towards a royal flush (Ace through Jack) plus a fifth card which makes a flush, and has elected to discard that fifth card.

Pool No. 2 means that the player has received four cards towards a royal flush (Ace through Jack), plus a fifth card which makes a straight (but not a straight flush, which would have resulted in an immediate win), and the player has discarded the fifth card. Note that the fifth card must be one of the three 10s.

Pool No. 3 means that the player has received four cards towards a royal flush (Ace through Jack), plus a fifth card which forms a pair (with one of the other cards), and has elected to discard the fifth card.

Pool No. 4 means that the player has received four cards towards a royal flush, plus another card which does not place the situation within the definition of Pool Nos. 1–3. The player has discarded this fifth card. Note that, in general, the pools are arranged in a descending hierarchy; a given pool excludes what is covered in a previous pool. The hierarchy also relates to optimal strategies for the given pay table. Pool No. 1 is the most optimal, No. 2 is the next, and so on, down to Pool No. 105 which is the least optimal.

Pool. No. 5 means that the player has received four cards towards a royal flush, including an Ace and 10, plus two other cards needed for a royal flush, plus another card of the same suit (but not making a combination covered by a previous pool). The player has discarded the fifth card.

Pool No. 6 is similar to No. 5, except that the fifth card forms a straight, and is discarded by the player.

Pool No. 7 means that the player receives four cards towards a royal flush, plus one card forming a pair (Jacks or better), and the player discards the fifth card.

Pool No. 8 is similar to No. 7. except that the fifth card does not form a pair (or any combination covered by the previous pools).

Pool Nos. 9–12 are similar to Pool Nos. 5–8, except that the player receives a King and 10 instead of Ace and 10.

Pool No. 13 means that the player has received four cards towards a straight flush, including a Queen, Jack, 10, and 9, with the fifth card not forming a straight or flush. The player has discarded the fifth card. In Pool No. 14, the cards held are Jack, 10, 9, 8, and in Pool No. 15, the cards held are 10 or below.

In Pool Nos. 16–19, the player receives four cards towards a flush, with either three, two, one, or zero high cards. A "high card" means a Jack or higher. The player discards the fifth card.

In Pool Nos. 20–23, the player receives four cards towards a straight, with either three, two, one, or zero high cards, and discards the fifth card.

In Pool No. 24, the player receives three of a kind, and discards the remaining two cards.

In Pool No. 25, the player receives two pairs, and discards the remaining card.

In Pool No. 26, the player receives one paying pair (Jacks or better), and discards the remaining cards.

In Pool No. 27, the player receives one small (non-paying) pair, and discards the remaining cards.

In Pool Nos. 28–32, the player receives three cards towards a royal flush, with the various combinations indicated. The player discards the remaining two cards.

In Pool Nos. 33–39, the player receives two cards towards a royal flush, with the various combinations indicated, and discards the remaining three cards.

In Pool No. 40, the player receives an Ace, King, Queen, and Jack (but not a combination covered in a previous pool), and discards the remaining card.

In Pool No. 41, the player receives a King, Queen, and Jack (but not a combination covered in a previous pool), and discards the remaining cards.

In Pool No. 42, the player receives two high cards, and discards one of them, plus the remaining cards.

In Pool Nos. 43–46, the player receives one high card (Ace, King, Queen, or Jack) and discards the remaining cards.

In Pool No. 47, the player has elected to discard the entire hand and draw new cards.

Pool Nos. 48–105 are sub-optimal for the pay table shown above. In Pool Nos. 48 and 49, the player has received one paying pair, and has held either one or two cards beyond that pair, and discarded the remainder. In Pool Nos. 50 and 51, the player receives one small (non-paying) pair, and has held either one or two cards, and discarded the remainder. In Pool No. 52, the player receives three of a kind, and holds one additional card, and discards the other card.

Pool Nos. 53–100 indicate combinations of cards which form parts of straights or flushes. The notation "OH" means that there are zero "holes" or gaps. Thus, Pool No. 53 means that the player receives three cards towards a straight, with no gaps, and with two high cards. An example is Queen, Jack, 10. The player has elected to discard the remaining two cards.

In each of the pool s from No. 54 through 100, the player holds the cards that make the partial straight or flush, and discards the others.

In Pool Nos. 101–104. the player receives four cards, with two gaps, and with three, two, one, or zero high cards. The player discards the fifth card.

In Pool No. 105, the player has received one small card, and elects to discard the other four cards.

The pools enumerated above are intended to cover all possible situations and all possible strategies that can be selected by the player. Thus, in practice, the correct pool can be determined. by a table lookup, and without any substantial calculation. For example, if a player receives four cards towards a royal flush, including an Ace and 10, but not a flush, straight, or pair, and if the player elects to discard the fifth card, then the system associates this occurrence with Pool No. 8. As used in this particular game, the term "occurrence" is defined as a hand presented to the player, followed by a strategy elected by the player. Thus, for each occurrence, there is a unique pool to which the system will refer.

To each pool, one associates ten weighted "bins" containing game set elements. (In practice, there are no real bins, but instead there is a mix of game set elements, each category of game set element being present in accordance with its weighting or probability.) The ten "bins" correspond to the ten basic categories of poker, i.e. Royal Flush, Straight Flush, Four of a Kind, Full House, Flush, Straight, Three of a Kind, Two Pair, One Pair Jacks or Better, and None of the Above (losing hand). For each bin, one must determine the number of ways to construct the category associated with that bin, by drawing the specified number of cards.

The construction of the bins can be understood with reference to the following example relating to the situation of Pool No. 1. Since Pool No. 1 is a decision pool involving the drawing of one new card, one must determine the number of ways to form each category by drawing one card:

Royal Flush:

There is one way to make a royal flush, namely by drawing a 10 having the same suit as the four cards held. Since there are 47 ways to draw a card (52 cards in the deck, minus the five cards initially dealt), the probability of this outcome is 1/47.

Straight Flush:

It is not possible to make a straight flush by drawing one card, given the cards already held. The probability of this outcome is zero.

Four of a Kind:

It is not possible to make four of a kind by drawing one card, given the cards already held. The probability of this outcome is zero.

Full House:

It is not possible to make a full house by drawing one card, given the cards already held. The probability of this outcome is zero.

Flush:

There are seven ways to make a flush (there are eight cards remaining in the suit, but one of those cards would make a royal flush, and is previously accounted for). The probability of this outcome is 7/47.

Straight:

There are three ways to make a straight. The probability of this outcome is 3/47.

Three of a Kind:

It is not possible to make three of a kind by drawing one card, given the cards already held. The probability of this outcome is zero.

Two Pairs:

It is not possible to make two pairs by drawing one card, given the cards already held. The probability of this outcome is zero.

One Pair Jacks or Better:

There are 12 ways to make one pair of Jacks or better by drawing one card. The probability of this outcome is 12/47.

There are 24 remaining ways of drawing one card. These are the losing hands. The probability of this outcome is 24/47.

One can similarly construct probabilities for each of the ten bins associated with each of the other decision pools. Note that for all pools which involve two-card draws, the total number of ways of drawing cards is 1081. For three-card draws, the number of ways is 16,215, etc. These numbers are simply the binomial coefficients which indicate the number of ways of selecting various numbers of objects from a set.

When one has determined probabilities for each possible outcome, one can proceed to construct the bins, by providing game set elements in the proper proportions. In the example shown above, the game set elements associated with decision pool No. 1 would be present in the following proportions:

1 game set element for a royal flush, 7 game set elements for a flush, 3 game set elements for a straight, 12 game set elements for one pair Jacks or better, and 24 game set elements for losing hands.

The numbers shown above represent proportions, and do not normally comprise the actual numbers of game set elements. To construct the actual pool of game set elements, one would usually multiply each of the above numbers by the same large integer, such as 10,000 or 1,000,000, while still preserving the weightings shown above.

As in the first phase of the game, the probabilities associated with the draws from the decision pools will change slightly as the pools are depleted. In the aggregate, however, as the games are played repeatedly and the pools are replenished, the actual probabilities will converge to the theoretical values.

As in the first phase of the game, the probabilities associated with the draws from the decision pools could also be determined arbitrarily, and without regard to the mathematical probabilities of obtaining various hands. The invention is intended to include this alternative.

In summary, in the video poker game described above, except for the relatively infrequent occasions where a player wins an award based on the initial hand received, each play involves two distinct draws from two different pools of game set elements. The first draw is made from the pool corresponding to initial dealt hands. The second draw, if needed, is from the weighted "bins" associated with a particular decision pool, the decision pool having been selected according to the hand presented to the player and the player's strategy. Thus, this embodiment essentially comprises two lotteries played in sequence.

The lottery poker game described above therefore has the advantage that it provides a "bonus" to the player. If the player does not win on the first play, the system gives the player another chance, by asking the player to select cards to be held or discarded. Then, the system operates another lottery, giving the player another chance to win an award.

In still another embodiment of the video poker game, there is only one lottery. In this alternative, the initial hand is randomly generated, not by selecting a game set element from a pool, but by generating a hand at random and displaying it to the player. Then, the player makes his or her decisions about which cards to hold, and the system proceeds as previously described. That is, based on the hand dealt to the player and the player's strategy, the system turns to one of the decision pools, and draws a game set element from that pool, according to a probability determined by the number of each type of game set element in the pool. This embodiment is therefore the same as the preceding version, except that the initial hand is not determined by drawing a game set element from a finite pool.

Figure 8:
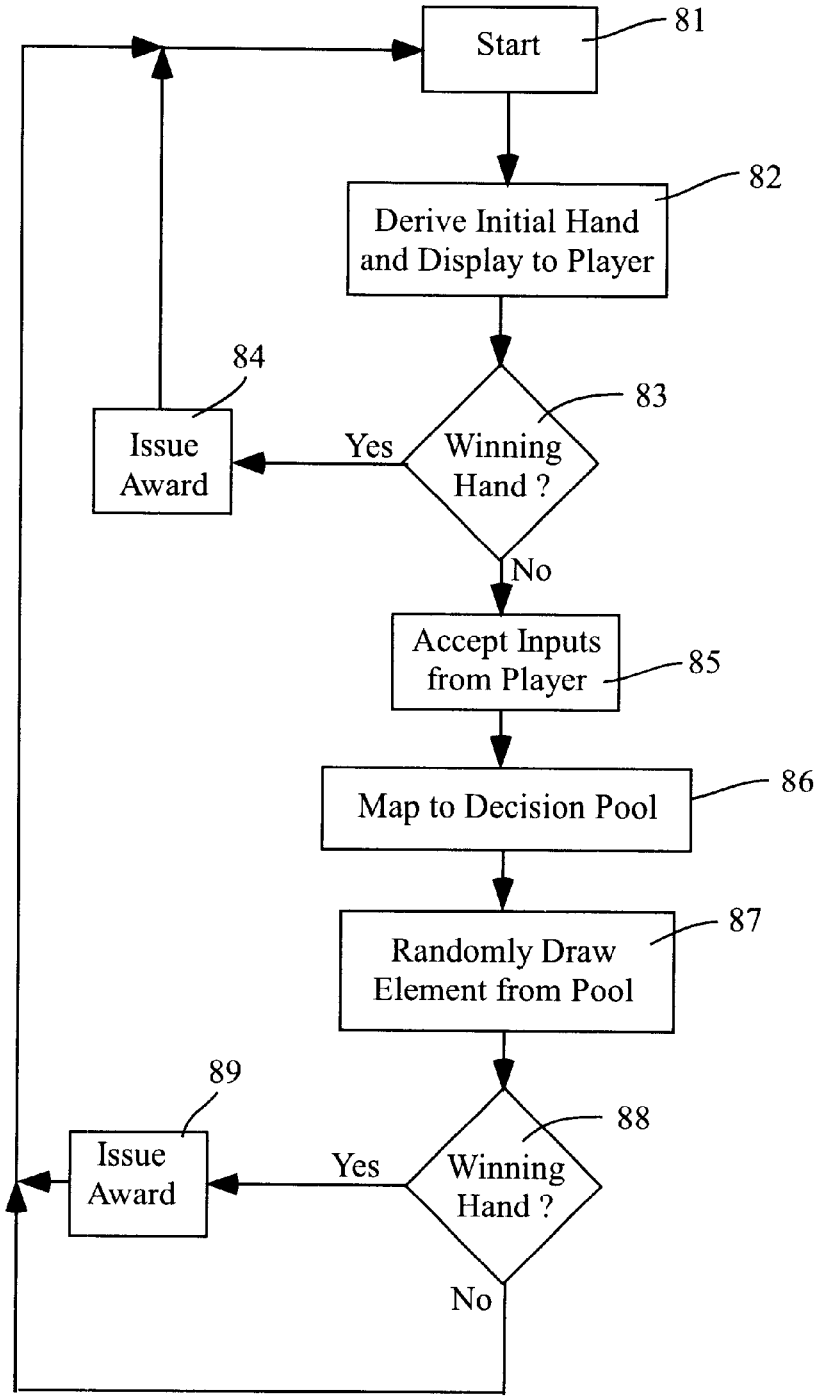
FIG. 8 provides a flow chart showing the programming of a video lottery poker game, in an alternative embodiment of the present invention.

FIG. 8 provides a flow chart summarizing the basic programming of the two alternative lottery poker embodiments described above. The system starts in block 81. In block 82, the system derives an initial hand and displays that hand to the player. Block 82 is intended to represent both of the two alternative embodiments discussed above. In the first of these alternatives, the initial hand is obtained by drawing a game set element from a finite pool. In the second of these alternatives, the initial hand is simply determined randomly, without reference to a finite pool.

In test 83, the system determines whether the initial hand is a winning hand, i.e. whether it corresponds to the enumerated categories which are intended to win an immediate award. If so, the system issues the award, in block 84, and the system returns to block 81 to start a new game.

If the hand is not a winning hand, the system continues in block 85, in which the system accepts inputs from the player. These inputs comprise decisions on whether to hold or replace each card. Based on the cards initially dealt to the player, and on the player's strategy exercised in block 85, the system maps these parameters to one of a plurality of decision pools, in block 86. The system then randomly draws a game set element from the selected decision pool, in block 87. If test 88 indicates that the resulting hand is a winner, the system issues an award in block 89. Otherwise, the system returns to block 81.

Note that, in the case where the initial hand is selected by drawing an element from a pool, the pool from which the element is drawn is not the same as the decision pool used later. Thus, for most plays, the game in this case comprises two draws from two different pools of game set elements.

The invention is not limited to the particular embodiments discussed above. The invention can be applied to many other kinds of games of chance and skill. The arrangement of player terminals and central game servers can also be modified in many ways, within the scope of the invention. These and other modifications, which will be apparent to the reader skilled in the art, should be considered within the spirit and scope of the following claims.

What is claimed is:

1. A method of playing a game on a gaming device, comprising:

a) accepting a wager from a player, and initiating a play, b) determining an amount to be paid to the player, said amount determined by subtracting a pre-determined value from a maximum award value, c) associating, with said amount, a symbol which corresponds to said amount, d) displaying said symbol to the player, e) paying said amount to the player, and f) adding said pre-determined value to at least one separate fund.

2.The method of claim 1, wherein said pre-determined value is paid to the player during a bonus game.

3. The method of claim 1, wherein said pre-determined value is periodically paid to players of the gaming device.

4. The method of claim 1, wherein said pre-determined value is randomly paid to players of the gaming device.

5. The method of claim 1, wherein said predetermined value is paid to players of the gaming device according to a predetermined schedule.

6. The method of claim 1, wherein said separate fund is a progressive jackpot, said progressive jackpot periodically paid to players of the gaming device.

7. The method of claim 1, wherein said separate fund is a progressive jackpot, said progressive jackpot randomly paid to players of the gaming device.

8. The method of claim 1, wherein said maximum award value is determined randomly.

9. The method of claim 1, wherein said maximum award value is determined by drawing at least one outcome from a fixed pool of awards.

10. A method of playing a game on a gaming device, comprising:

a) accepting a wager from a player, and initiating a play, b) determining a maximum amount to be paid to the player, c) providing information to the player to enable the player to select a game strategy, d) receiving input from the player representing said game strategy, e) determining whether said input corresponds to a predetermined game strategy, f) calculating an actual amount to be paid to the player, said actual amount being equal to said maximum amount if the input from the player comprises said predetermined strategy, said actual amount being less than or equal to said maximum amount if the input from the player does not comprise said pre-determined strategy, g) associating, with said actual amount, a symbol which corresponds to said actual amount, h) displaying said symbol to the player, i) crediting the player with said actual amount, and j) adding a difference between said maximum amount and said actual amount if the input from the player comprises said predetermined strategy to at least one separate fund.

11. The method of claim 10, wherein said difference between the maximum amount and the actual amount is paid to the player during a bonus game on the gaming device.

12. The method of claim 10, wherein said predetermined strategy comprises an optimal strategy.

13. The method of claim 10, wherein said at least one separate fund comprises an award bank, said award bank coupled for communication to at least one other gaming device.

14. The method of claim 13, further comprising the step of periodically awarding funds from the award bank, to a player, on a random basis.

15. The method of claim 13, further comprising the step of periodically awarding funds from the award bank, to a player, according to a pre determined schedule.

16. The method of claim 13, wherein said award bank is a progressive jackpot, said progressive jackpot periodically paid to players of the gaming device.

17. The method of claim 10, wherein said actual amount corresponds to a plurality of symbols, and wherein act (f) comprises selecting one of said plurality of symbols corresponding to said actual amount.

18. The method of claim 17, wherein said one of said plurality of symbols is selected by randomly choosing the symbol according to a uniform probability distribution.

19. The method of claim 13, wherein said award bank is a progressive jackpot, said progressive jackpot randomly paid to players of the gaming device.

20. The method of claim 10, wherein said maximum amount is determined randomly.

21. The method of claim 10, wherein said maximum amount is determined by drawing at least one outcome from a fixed pool of awards.

22. A method of playing a game, comprising:

a) accepting a wager from a player, and initiating a play, b) selecting a game set element from a finite pool of game set elements, each game set element being coded with an amount to be paid to the player, c) adjusting said amount according to previous game plays, to produce an adjusted amount, wherein during at least one of said previous game plays, a difference between a maximum award of said at least one of said previous game plays and an actual award of said at least one of said previous game plays is used to adjust said amount to be paid to the player;

d) associating, with said game set element, a symbol which corresponds to said adjusted amount, and e) displaying said symbol to the player, and crediting the player with said adjusted amount.

23. The method of claim 22, wherein said one of said plurality of symbols is selected by randomly choosing the symbol according to a uniform probability distribution.

24. The method of claim 22, wherein an aggregate of amounts represented by said finite pool of game set elements are eventually paid out to players.

25. A method of playing a game, comprising:

a) accepting a wager from a player, and initiating a play, b) selecting a game set element from a finite pool of game set elements, each game set element being coded with a maximum amount available to be paid to the player on a particular play, c) providing information to the player to enable the player to select a game strategy, d) receiving input from the player, and determining whether said in put comprises a predetermined game strategy, e) calculating an actual amount to be paid to the player, said actual amount being equal to said maximum amount if the input from the player comprises said predetermined strategy, f) associating, with said actual amount, a symbol which corresponds to said actual amount, g) displaying said symbol to the player, and crediting the player with said actual amount, and h) adding a difference between said maximum amount and said actual amount to at least one separate fund.

26. The method of claim 25, wherein said at least one separate fund is paid to said player during a bonus game.

27. The method of claim 25, wherein act (b) comprises randomly selecting the game set element.

28. The method of claim 25, wherein said predetermined game strategy comprises an optimal strategy.

29. The method of claim 28, wherein said actual amount calculated in act (e) is less than or equal to said maximum amount if the input from the player does not comprise an optimal strategy.

30. The method of claim 25, wherein said actual amount is computed according to a predetermined probability distribution if the input from the player does not comprise said pre-determined strategy.

31. The method of claim 25, wherein said at least one separate fund comprises an award bank.

32. The method of claim 31, wherein said award bank is a progressive jackpot, said progressive jackpot periodically paid to players of the gaming device.

33. The method of claim 31, wherein said award bank is a progressive jackpot, said progressive jackpot randomly paid to players of the gaming device.

34. The method of claim 25, wherein said actual amount corresponds to a plurality of symbols, and wherein step (e) comprises selecting one of said plurality of symbols corresponding to said actual amount.

35. The method of claim 34, wherein said one of said plurality of symbols is selected by randomly choosing the symbol according to a uniform probability distribution.

36. A method of playing a game of video poker, comprising:

a) accepting a wager from a player, and initiating a play, b) selecting a game set element from a finite pool of game set elements, each game set element being coded with a maximum amount to be paid to the player, each game set element representing a category of poker hand corresponding to said maximum amount, c) displaying a hand to the player, the displayed hand being selected from a table of hands which can be played to achieve said maximum amount, d) receiving input from the player, said input comprising at least one decision on whether to hold each card of the displayed hand, e) determining whether said input comprises an optimal game strategy, f) calculating an actual amount to be paid to the player, said actual amount being equal to said maximum amount if the input from the player comprises an optimal strategy, said actual amount being different from said maximum amount if the input from the player does not comprise an optimal strategy, g) associating, with said actual amount, a modified hand of cards which corresponds to said actual amount, h) displaying said modified hand of cards to the player, and crediting the player with said actual amount, and i) adding, to an award bank, a difference between the maximum amount and the actual amount calculated in act (f).

37. The method of claim 36, wherein said actual amount corresponds to a plurality of hands of cards, and wherein act (f) comprises randomly selecting one of said plurality of hands corresponding to said actual amount.

38. The method of claim 36, wherein, when the player plays sub-optimally, said actual amount is calculated by evaluating other categories of hands according to a predetermined probability distribution.

39. The method of claim 36, wherein a predetermined fraction of each wager made by the player is added to the award bank, wherein awards from the award bank are periodically awarded to players.

40. The method of claim 36, wherein said award bank is a progressive jackpot, said progressive jackpot periodically paid to players of the game.

41. The method of claim 36, wherein said award bank is a progressive jackpot, said progressive jackpot randomly paid to players of the game.

42. The method of claim 36, wherein said award bank comprising a bonus amount paid to said player during a bonus game.

43. Apparatus for playing a game of video poker, comprising:

a) means for accepting a wager from a player, and for initiating a play, b) means for selecting a game set element from a finite pool of game set elements, each game set element being coded with a maximum amount to be paid to the player, each game set element representing a category of poker hand corresponding to said maximum amount, c) means for displaying a hand to the player, the displayed hand being selected from a table of hands which can be played to achieve said maximum amount, d) means for receiving input from the player, said input comprising at least one decision on whether to hold each card of the displayed hand, e) means for determining whether said in-put comprises an optimal game strategy, f) means for calculating an actual amount to be paid to the player, said actual amount being equal to said maximum amount if the input from the player comprises an optimal strategy, said actual amount being different from said maximum amount if the input from the player does not comprise an optimal strategy, g) means for associating, with said actual amount, a modified hand of cards which corresponds to said actual amount, and h) means for displaying said modified hand of cards to the player, and for crediting the player with said actual amount.

44. Apparatus for playing a video lottery poker game, comprising:

a) means for displaying an initial hand of simulated cards to a player, b) means for making an award to the player if said initial hand comprises a winning hand, each game set element being coded with a maximum amount to be paid to the player, c) means for accepting from the player at least one decision concerning which cards to hold and which cards to replace if said initial hand is not a winning hand, d) means for selecting a finite decision pool according to the initial hand and the player's decision, e) means for drawing a game set element from said decision pool, said game set element from said decision pool corresponding to a modified hand resulting from the player's decision, f) means for making an actual award to the player if said modified hand comprises a winning hand, said actual award comprising less than the maximum amount if said player's decision does not comprise optimal play, and g) means for adding a difference between said maximum amount and said actual award to at least one award bank.

45. The apparatus of claim 44, wherein the displaying means comprises means for drawing a game set element from a finite pool, said finite pool being distinct from said decision pool.

46. The apparatus of claim 44, wherein the displaying means comprises means for randomly selecting simulated cards to be displayed without depleting any finite pool.

47. The method of claim 44, wherein said award bank is a progressive jackpot, said progressive jackpot periodically paid to players of the game.

48. The method of claim 44, wherein said award bank is a progressive jackpot, said progressive jackpot randomly paid to players of the game.

49. The method of claim 44, wherein said award bank comprising a bonus amount paid to said player during a bonus game.

50. A gaming device comprising:

a) means for accepting a wager from a player, and initiating a play, b) means for determining an amount to be paid to the player, said amount determined by subtracting a predetermined value from a maximum award value, c) means for associating, with said amount, a symbol which corresponds to said amount, d) means for displaying said symbol to the player, e) means for paying said amount to the player, and f) means for adding said pre-determined value to at least one separate fund.

51. The gaming device of claim 50, wherein said predetermined value is paid to the player during a bonus game.

52. The gaming device of claim 50, wherein said predetermined value is periodically paid to players of the gaming device.

53. The gaming device of claim 50, wherein said predetermined value is randomly paid to players of the gaming device.

54. The gaming device of claim 50, wherein said predetermined value is paid to players of the gaming device according to a predetermined schedule.

55. The gaming device of claim 50, wherein said separate fund is a progressive jackpot, said progressive jackpot periodically paid to players of the gaming device.

56. The gaming device of claim 50, wherein said separate fund is a progressive jackpot, said progressive jackpot randomly paid to players of the gaming device.

57. The gaming device of claim 50, wherein said maximum award value is determined randomly.

58. The gaming device of claim 50, wherein said maximum award value is determined by drawing at least one outcome from a fixed pool of awards.

59. A gaming device comprising:

a) means for accepting a wager from a player, and initiating a play, b) means for determining a maximum amount to be paid to the player, c) means for providing information to the player to enable the player to select a game strategy, d) means for receiving input from the player representing said game strategy, e) determining whether said input corresponds to a predetermined game strategy, f) means for calculating an actual amount to be paid to the player, said actual amount being equal to said maximum amount if the input from the player comprises said predetermined strategy, said actual amount being less than or equal to said maximum amount if the input from the player does not comprise said pre-determined strategy, g) means for associating, with said actual amount, a symbol which corresponds to said actual amount, h) means for displaying said symbol to the player, i) means for crediting the player with said actual amount, and j) means for adding a difference between said maximum amount and said actual amount if the input from the player comprises said predetermined strategy to at least one separate fund.

60. The gaming device of claim 59, wherein said difference between the maximum amount and the actual amount is paid to the player during a bonus game on the gaming device.

61. The gaming device of claim 59, wherein said predetermined strategy comprises an optimal strategy.

62. The gaming device of claim 59, wherein said at least one separate fund comprises an award bank, said award bank coupled for communication to at least one other gaming device.

63. The gaming device of claim 62, further comprising means for periodically awarding funds from the award bank, to a player, on a random basis.

64. The gaming device of claim 62, further comprising means for periodically awarding funds from the award bank, to a player, according to a pre determined schedule.

65. The gaming device of claim 59, wherein said actual amount corresponds to a plurality of symbols, and wherein said means for calculating an actual amount comprises means for selecting one of said plurality of symbols corresponding to said actual amount.

66. The gaming device of claim 65, wherein said one of said plurality of symbols is selected by randomly choosing the symbol according to a uniform probability distribution.

67. The gaming device of claim 62, wherein said award bank is a progressive jackpot, said progressive jackpot periodically paid to players of the gaming device.

68. The gaming device of claim 62, wherein said award bank is a progressive jackpot, said progressive jackpot randomly paid to players of the gaming device.

69. The gaming device of claim 59, wherein said maximum amount is determined randomly.

70. The gaming device of claim 59, wherein said maximum amount is determined by drawing at least one outcome from a fixed pool of awards.

71. A gaming device comprising:

a) means for accepting a wager from a player, and initiating a play, b) means for selecting a game set element from a finite pool of game set elements, each game set element being coded with an amount to be paid to the player, c) means for adjusting said amount according to previous game plays, to produce an adjusted amount, wherein during at least one of said previous game plays, a difference between a maximum award of said at least one of said previous game plays and an actual award of said at least one of said previous game plays is used to adjust said amount to be paid to the player;

d) means for associating, with said game set element, a symbol which corresponds to said adjusted amount, and e) means for displaying said symbol to the player, and crediting the player with said adjusted amount.

72. The gaming device of claim 71, wherein said one of said plurality of symbols is selected by randomly choosing the symbol according to a uniform probability distribution.

73. The gaming device of claim 71, wherein an aggregate of amounts represented by said finite pool of game set elements are eventually paid out to players.

74. A gaming device comprising:

a) means for accepting a wager from a player, and initiating a play, b) means for selecting a game set element from a finite pool of game set elements, each game set element being coded with a maximum amount available to be paid to the player on a particular play, c) means for providing information to the player to enable the player to select a game strategy, d) means for receiving input from the player, and determining whether said in put comprises a predetermined game strategy, e) means for calculating an actual amount to be paid to the player, said actual amount being equal to said maximum amount if the input from the player comprises said predetermined strategy, f) means for associating, with said actual amount, a symbol which corresponds to said actual amount, g) means for displaying said symbol to the player, and crediting the player with said actual amount, and h) means for adding a difference between said maximum amount and said actual amount to at least one separate fund.

75. The gaming device of claim 74, wherein said at least one separate fund is paid to said player during a bonus game.

76. The gaming device of claim 74, wherein said means for selecting a game set element comprises randomly selecting the game set element.

77. The gaming device of claim 74, wherein said predetermined game strategy comprises an optimal strategy.

78. The gaming device of claim 74, wherein said actual amount is less than or equal to said maximum amount if the input from the player does not comprise an optimal strategy.

79. The gaming device of claim 74, wherein said actual amount is computed according to a predetermined probability distribution if the input from the player does not comprise said pre-determined strategy.

80. The gaming device of claim 74, wherein said at least one separate fund comprises an award bank.

81. The gaming device of claim 74, wherein said actual amount corresponds to a plurality of symbols, and wherein said means for calculating an actual amount comprises selecting one of said plurality of symbols corresponding to said actual amount.

82. The gaming device of claim 81, wherein said one of said plurality of symbols is selected by randomly choosing the symbol according to a uniform probability distribution.

83. The gaming device of claim 80, wherein said award bank is a progressive jackpot, said progressive jackpot periodically paid to players of the gaming device.

84. The gaming device of claim 80, wherein said award bank is a progressive jackpot, said progressive jackpot randomly paid to players of the gaming device.

85. A gaming device comprising:

a) means for accepting a wager from a player, and initiating a play, b) means for selecting a game set element from a finite pool of game set elements, each game set element being coded with a maximum amount to be paid to the player, each game set element representing a category of poker hand corresponding to said maximum amount, c) means for displaying a hand to the player, the displayed hand being selected from a table of hands which can be played to achieve said maximum amount, d) means for receiving input from the player, said input comprising at least one decision on whether to hold each card of the displayed hand, e) means for determining whether said input comprises an optimal game strategy, f) means for calculating an actual amount to be paid to the player, said actual amount being equal to said maximum amount if the input from the player comprises an optimal strategy, said actual amount being different from said maximum amount if the input from the player does not comprise an optimal strategy, g) means for associating, with said actual amount, a modified hand of cards which corresponds to said actual amount, h) means for displaying said modified hand of cards to the player, and crediting the player with said actual amount, and i) means for adding, to an award bank, a difference between the maximum amount and the actual amount to be paid to the player.

86. The gaming device of claim 85, wherein said actual amount corresponds to a plurality of hands of cards, and wherein said means for calculating an actual amount comprises randomly selecting one of said plurality of hands corresponding to said actual amount.

87. The gaming device of claim 85, wherein, when the player plays sub-optimally, said actual amount is calculated by evaluating other categories of hands according to a predetermined probability distribution.

88. The gaming device of claim 85, wherein a predetermined fraction of each wager made by the player is added to the award bank, wherein awards from the award bank are periodically awarded to players.

89. The gaming device of claim 85, wherein said award bank is a progressive jackpot, said progressive jackpot periodically paid to players of the game.

90. The gaming device of claim 85, wherein said award bank is a progressive jackpot, said progressive jackpot randomly paid to players of the game.

91. The gaming device of claim 85, wherein said award bank comprising a bonus amount paid to said player during a bonus game.

* * * * *